US011744387B1

(12) United States Patent
Kerr et al.

(10) Patent No.: US 11,744,387 B1
(45) Date of Patent: Sep. 5, 2023

(54) CUSTOMIZABLE PRODUCT STORAGE AND DISPLAY SYSTEM

(71) Applicant: DIAM UK LTD, Leicestershire (GB)

(72) Inventors: Eamonn Kerr, Leicestershire (GB); James Miller, Derbyshire (GB); Howard Gaskin, Leicestershire (GB)

(73) Assignee: DIAM UK LTD, Leicestershire (GB)

( * ) Notice: Subject to any disclaimer, the term of this patent is extended or adjusted under 35 U.S.C. 154(b) by 0 days.

(21) Appl. No.: 17/806,347

(22) Filed: Jun. 10, 2022

Related U.S. Application Data

(60) Provisional application No. 63/202,429, filed on Jun. 10, 2021.

(51) Int. Cl.
*A47F 1/12* (2006.01)
*A47F 5/00* (2006.01)
*A47F 3/00* (2006.01)

(52) U.S. Cl.
CPC ..... *A47F 1/126* (2013.01); *A47F 1/125* (2013.01); *A47F 3/001* (2013.01); *A47F 5/005* (2013.01); *A47F 5/0025* (2013.01)

(58) Field of Classification Search
CPC ..... A47F 1/126; A47F 5/0025; A47F 5/005; A47F 5/0846; A47F 5/0853; A47F 1/125; A47F 3/001; A47F 3/004; A47F 5/10; A47F 5/16; A47B 95/008
USPC ..... 211/59.2, 51, 59.3, 119.003, 184
See application file for complete search history.

(56) References Cited

U.S. PATENT DOCUMENTS 4,757,915 A * 7/1988 Albright ..... G07F 11/42 221/75
5,673,801 A * 10/1997 Markson ..... A47F 1/126 211/59.3
5,746,328 A * 5/1998 Beeler ..... A47F 1/126 211/59.3
6,076,670 A * 6/2000 Yeranossian ..... A47F 1/126 221/124
6,082,557 A * 7/2000 Leahy ..... A47B 96/021 211/59.3
6,234,328 B1 * 5/2001 Mason ..... A47F 5/0037 248/242
6,533,131 B2 * 3/2003 Bada ..... A47F 1/126 211/184
7,201,281 B1 * 4/2007 Welker ..... A47F 1/126 211/59.3
7,641,072 B1 * 1/2010 Vlastakis ..... A47F 3/002 221/229
7,828,158 B2 * 11/2010 Colelli ..... A47F 3/002 211/59.3
8,061,539 B2 * 11/2011 Punzel ..... A47B 47/021 248/220.21

(Continued)

*Primary Examiner* — Jennifer E. Novosad
(74) *Attorney, Agent, or Firm* — Gottlieb, Rackman & Reisman, P.C.

(57) ABSTRACT

A shelving system includes a shelving unit with at least one open sidewall that provides access to an interior of the shelving unit and one or more inserts that can be selectively connected to and disconnected from an interior of the unit in order to compartmentalize the interior of the unit. This enables a user to separate, sort and store items in the interior in an orderly fashion. The at least one open sidewall also serves to display the items stored in the unit. The shelving unit can be attached to a supporting wall in order to be located at desirable height to facilitate storage and display of the items stored therein.

7 Claims, 32 Drawing Sheets

(56) References Cited

U.S. PATENT DOCUMENTS 8,172,094 B2 * 5/2012 Meyer ..... A47F 5/005 211/59.3
8,657,154 B2 * 2/2014 Obitts ..... G07F 11/64 221/124
8,985,352 B2 * 3/2015 Bergdoll ..... A47B 57/16 211/59.3
9,016,482 B2 * 4/2015 Kim ..... A47F 1/126 211/59.2
9,521,913 B2 * 12/2016 Vogler ..... A47F 1/126
9,642,475 B2 * 5/2017 Vogler ..... A47F 5/0846
10,064,501 B2 * 9/2018 Hester-Redmond .... A47F 1/125
10,178,909 B2 * 1/2019 Hardy ..... A47F 7/0007
10,306,997 B2 * 6/2019 Eizinas ..... A47F 5/16
10,334,970 B2 * 7/2019 Buck ..... A47B 57/406
10,638,856 B2 * 5/2020 Nagel ..... A47F 5/005
10,952,548 B2 * 3/2021 Pollpeter ..... F21S 4/28
10,959,540 B2 * 3/2021 Padvoiskis ..... A47B 57/586
11,317,739 B2 * 5/2022 Kerr ..... A47F 1/128
11,540,628 B2 * 1/2023 Brück ..... G08B 13/1436
2004/0140279 A1 * 7/2004 Mueller ..... A47F 1/126 211/59.3
2006/0049122 A1 * 3/2006 Mueller ..... A47F 1/126 211/59.3
2006/0260518 A1 * 11/2006 Josefsson ..... A47F 5/0068 108/61
2007/0068885 A1 * 3/2007 Busto ..... A47F 1/125 211/59.3
2008/0035589 A1 * 2/2008 Rasmussen ..... A47F 1/126 211/59.3
2008/0203256 A1 * 8/2008 Medcalf ..... A47F 5/005 248/231.81
2009/0184130 A1 * 7/2009 Miller ..... A47F 1/126 221/282
2009/0248198 A1 * 10/2009 Siegel ..... G06Q 10/08 700/231
2009/0277853 A1 * 11/2009 Bauer ..... A47F 1/087 211/59.3
2010/0012603 A1 * 1/2010 Takashima ..... A47F 5/0846 211/59.3
2012/0228242 A1 * 9/2012 Vogler ..... A47F 1/126 211/59.3
2013/0193156 A1 * 8/2013 Kaleta ..... A47F 1/126 221/247
2015/0076093 A1 * 3/2015 Theisen ..... G09F 3/204 211/85.26
2017/0035218 A1 * 2/2017 Riley ..... A47F 1/126
2018/0213946 A1 * 8/2018 Vanos ..... A47F 1/125
2019/0223627 A1 * 7/2019 Standen ..... A47F 1/121
2019/0376655 A1 * 12/2019 Sburlan ..... A47G 23/0266
2020/0253393 A1 * 8/2020 Wills ..... A47F 5/0846
2021/0161310 A1 * 6/2021 Berglund ..... A47F 1/126
2021/0227996 A1 * 7/2021 Kerr ..... A47F 5/0006
2022/0287479 A1 * 9/2022 Sherretts ..... A47F 3/02

* cited by examiner

CUSTOMIZABLE PRODUCT STORAGE AND DISPLAY SYSTEM

CROSS-REFERENCE TO RELATED APPLICATION

This application claims priority under 35 U.S.C. § 119 to U.S. Provisional Patent Application No. 63/202,429, filed on Jun. 10, 2021, the disclosure of which is incorporated by reference herein in its entirety.

TECHNICAL FIELD

The present invention relates to a product storage and display system, and more particularly, to a customizable product storage and display system.

DISCUSSION OF THE RELATED ART

The use of display shelving for presenting products to a user is well known. In one configuration such displays take the form of a shelving framework to which display structures are attached, such as shelf dividers, display cubbies, hang bars and pusher assemblies. Different combinations of display structures can be used to provide a customized product display presentation. Often a merchant will want to change a product display configuration. This requires removing the current display structures from the framework and rearranging or replacing them with other structures.

Conventional systems that can be customized in this manner can be mechanically complicated and difficult to install and remove. Such systems also typically require a complex back wall on the shelving framework to receive the display structures. The system complexity increases overall cost both in terms of initial purchase of display structures and time expended to install and remove them. In addition, individual display structures must often be replaced in their entirety when changing layout. In order for a merchant to be able to flexibly change the display, a large inventory of replacement display structures may be required, further increasing cost.

There is a need for an improved customizable product display system that can be easily installed on a support framework and also is easier than conventional systems to re-set into different configurations. There is a further need for such a product display system which is less complex than conventional systems and requires fewer discrete components to be used and kept in inventory relative to conventional systems.

SUMMARY

The present invention provides a storage system that can easily be customized to store and display items of various shapes and sizes.

A storage system of the present invention includes a storage unit and one or more display inserts that can be selectively coupled to the storage unit, such as dividers, hang rod and pusher assemblies, and single or multi-level cubby modules, for the purpose of compartmentalizing the interior storage area the storage unit. The storage unit may alternatively be referred to as a shelving unit, a shelving device, a caddy, a storage device, or simply a device. The divider inserts may be referred to as inserts for brevity purposes.

The caddy is configured to allow a large number of different kinds of inserts to be selectively coupled to the interior of the caddy and easily removed and replaced to reconfigure the display while the caddy portion itself can remain in place. Particularly, the front wall of the caddy has a plurality of lip sections that protrude above the bottom wall of the caddy. These lip sections define insertion slots adjacent to the front wall of the caddy. One insert embodiment has a front end with a bar-shaped protrusion which can be inserted in one of the insertion slots for coupling the front end of the insert to the front region of the caddy.

The back wall of the caddy can have an elongated gap extending across its length and a plurality of elongated through openings. In one embodiment an insert has a clip that can be inserted through the gap at the rear wall of the caddy to connect the insert with the rear wall of the caddy. In a different embodiment Alternatively, an insert can have protrusions at its rear end which can be inserted into the elongated through openings at the rear wall of the caddy in order to connect the rear end of the insert to the rear wall of the caddy.

Each insert can have a structural configuration configured for storing, sorting and displaying items of a certain size and/or shape therein. In other words, a caddy of the present invention can be selectively configured and reconfigured to efficiently and attractively store and sort items of a particular size and shape, and to prominently display the stored items to viewers. Allowing different types of inserts to be quickly and easily mounted to/un-mounted from the front and rear walls of a caddy, without having to remove the caddy itself from the display system is particularly useful in a retail setting when a merchant may frequently change the type of inventory stored and displayed to potential customers and want to alter how it is displayed in an efficient manner.

The caddy is configured to be selectively mounted to a wall . This can be done by selectively coupling an elongated groove that runs along the rear wall of the caddy to an elongated tongue that protrudes from the load-bearing wall. In an alternative mounting configuration, selectively removable brackets are attached to the caddy and which have a plurality of tines at their distal ends that can be selectively inserted in receiving openings in the load-bearing wall, such as holes in a pegboard or slots in a shelf bracket support, to connect the caddy to the wall. A plurality of caddies can be quickly and easily mounted to the load-bearing wall in a a variety of different configurations.

The ease of selectively mounting a caddy of the present invention to a desired location on a load-bearing wall in conjunction with the ease of compartmentalizing the interior of a caddy with different allows for a merchandise display to be quickly and efficiently installed, configured, and reconfigured, thereby reducing labor costs and other expenses.

BRIEF DESCRIPTION OF THE DRAWINGS

The above and other features of the present invention will become more apparent by describing in detail exemplary embodiments thereof in conjunction with the accompanying drawings, in which.

DETAILED DESCRIPTION OF THE EMBODIMENTS

Figure 1A:
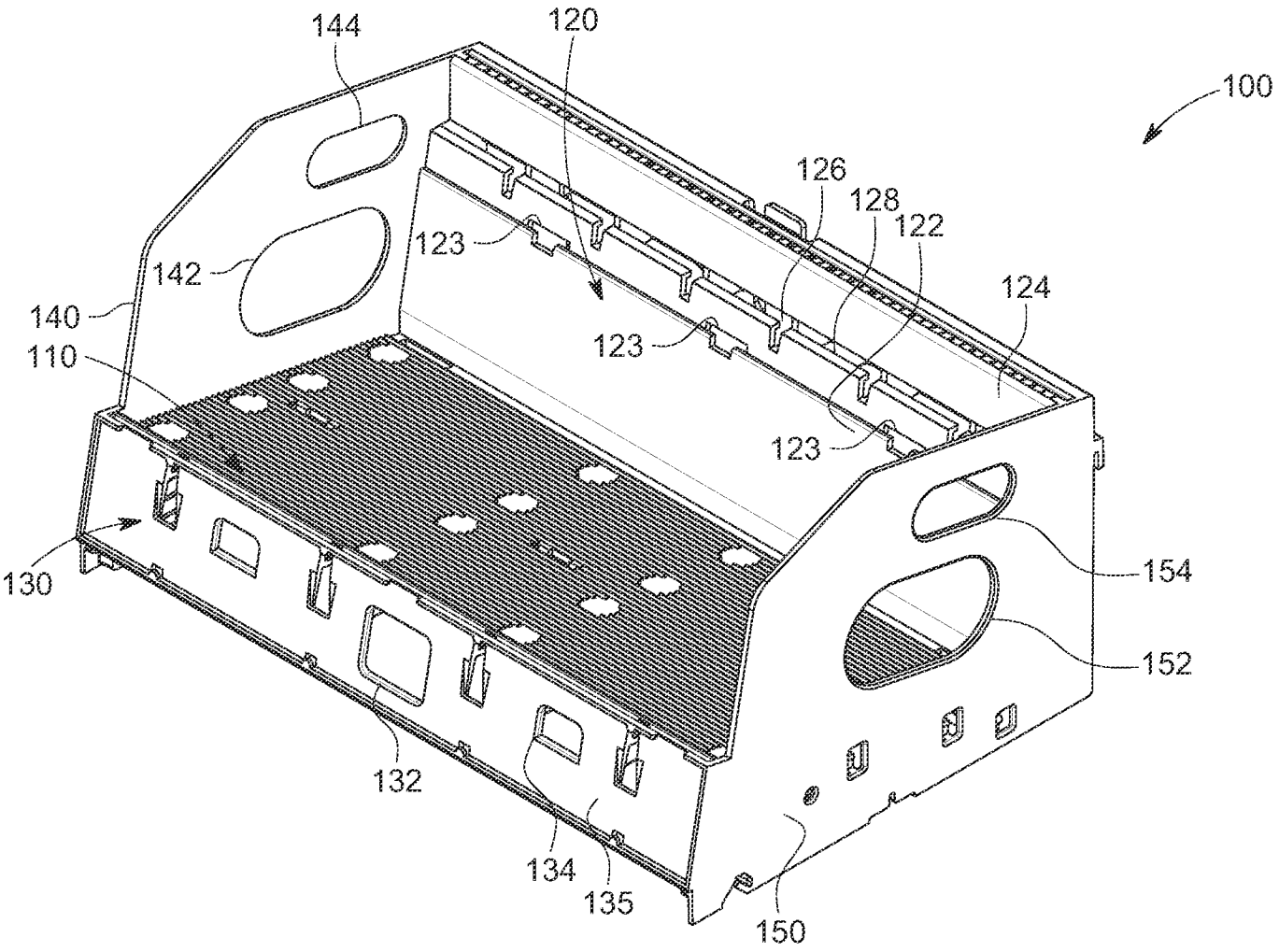
FIG. 1A is a perspective view illustrating a storage device according to an exemplary embodiment of the present invention.
Figure 1B:
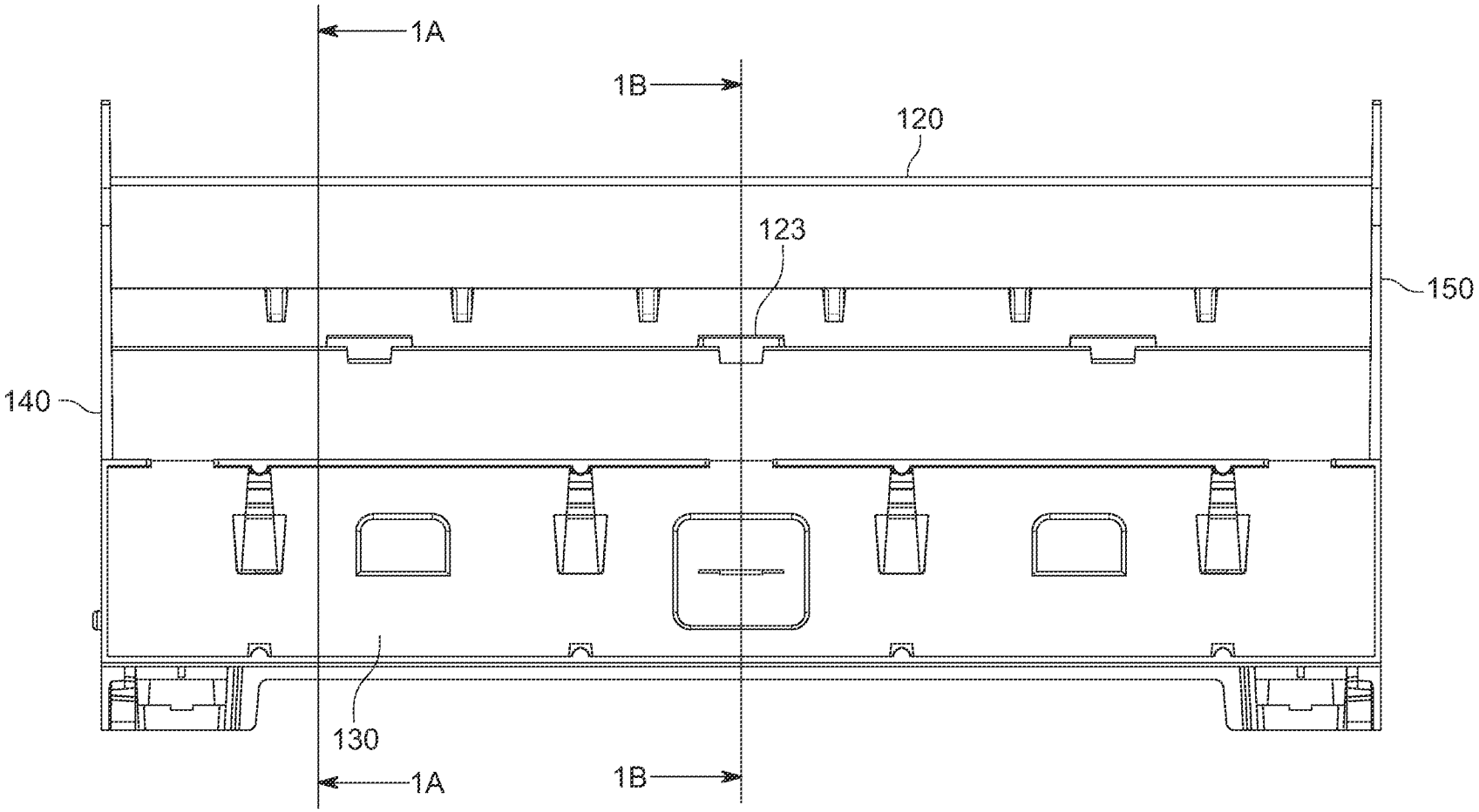
FIG. 1B is a front view illustrating the storage device of FIG. 1A.

Exemplary embodiments of the present invention will be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

FIGS. 1A-1E illustrate a storage device or caddy that is configured to be selectively connected to a load-bearing wall such as a pegwall, an urbanwall, etc., in order to be loaded with items to be displayed to viewers. The storage device of FIGS. 1A-1E is configured to have a large number of different kinds of inserts be selectively connected to its front and rear walls. This enables a user to quickly and easily compartmentalize the interior of the storage device based on the type, size and shape of the items that will be (and/or already are) stored in the device.

Therefore, when a user needs to store and display items of a different kind (such as during rearrangement/replenishment of inventory), the user can simply remove the existing insert from a given storage device and selectively couple a different insert (that is appropriate for the new items) to the front and/or rear walls of the device as opposed to needing to replace the entire storage device by un-mounting it from the load-bearing wall and installing a new storage device in its place. The configuration of the storage device and inserts of the present invention is advantageous because it is easier, quicker and more cost efficient to replace just the insert(s) in the interior of a storage device than to replace the storage device itself.

Figure 2A:
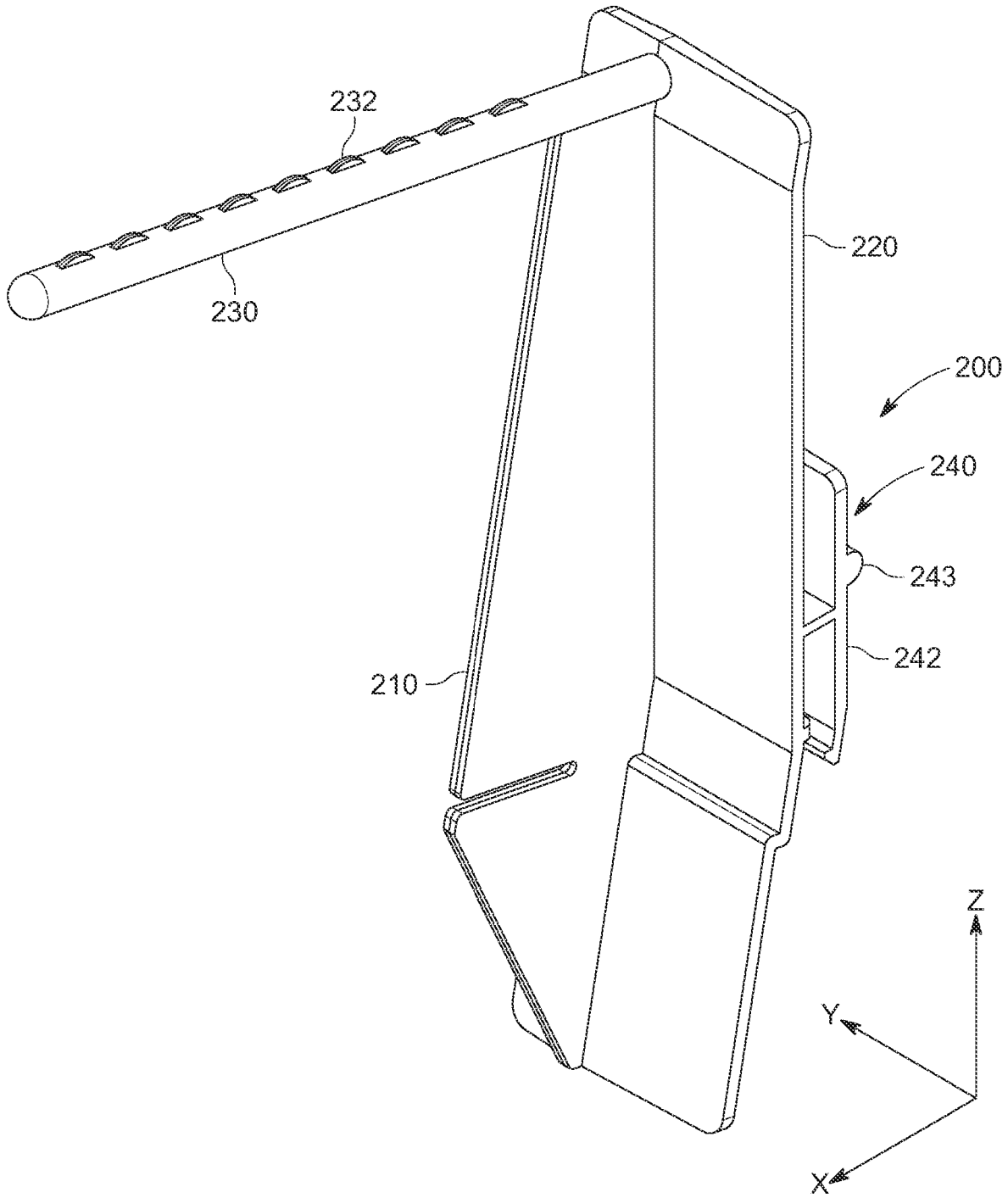
FIG. 2A is a perspective view illustrating an insert that is configured to be selectively coupled to the storage device of FIG. 1A.
Figure 2B:
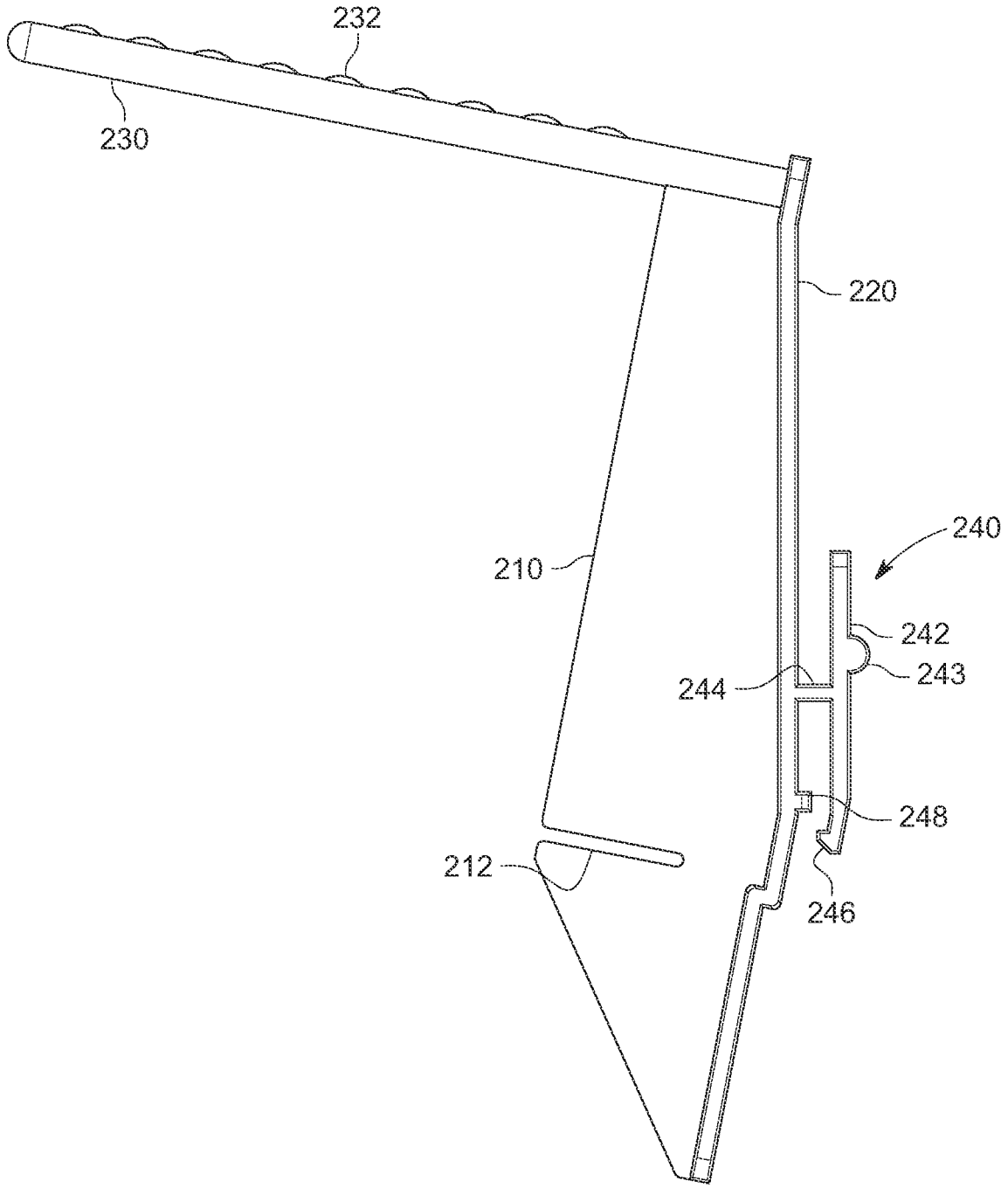
FIG. 2B is a side view illustrating the insert of FIG. 2A.
Figure 7A:
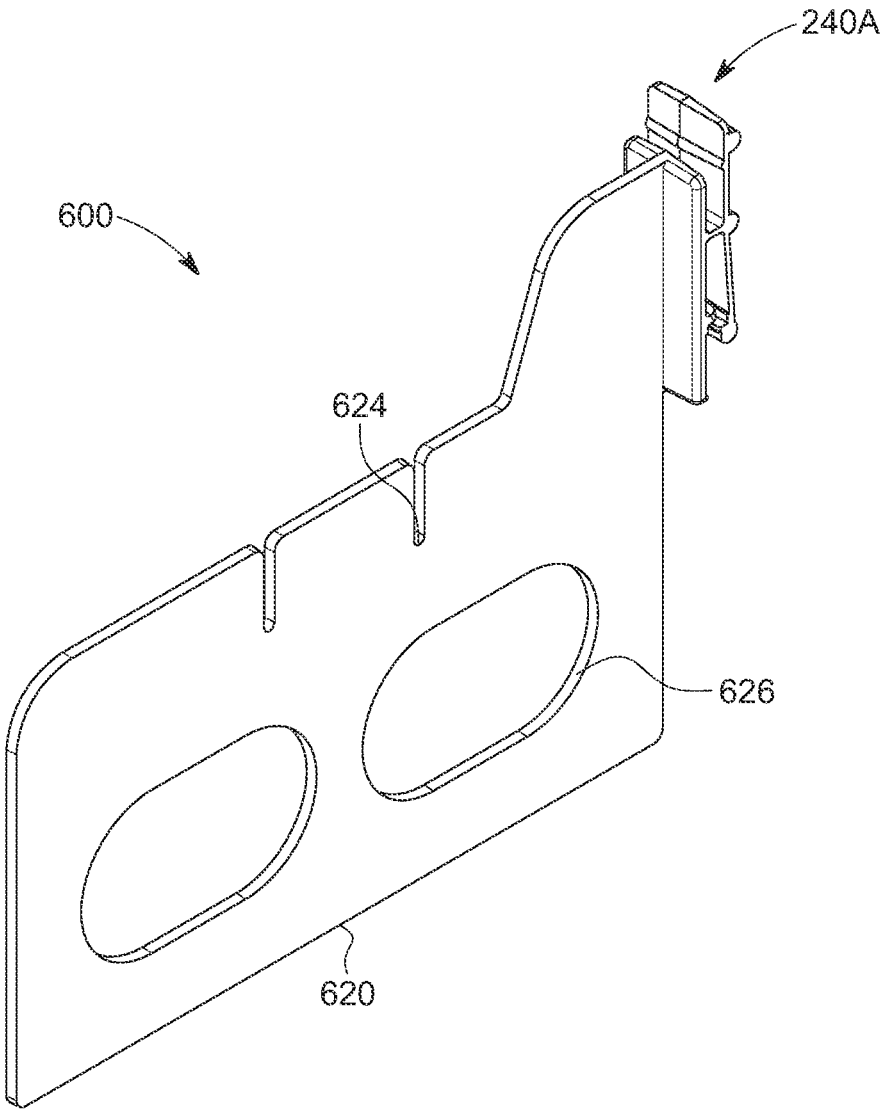
FIG. 7A is a perspective view illustrating an insert that is configured to be selectively coupled to the storage device of FIG. 1A.
Figure 7B:
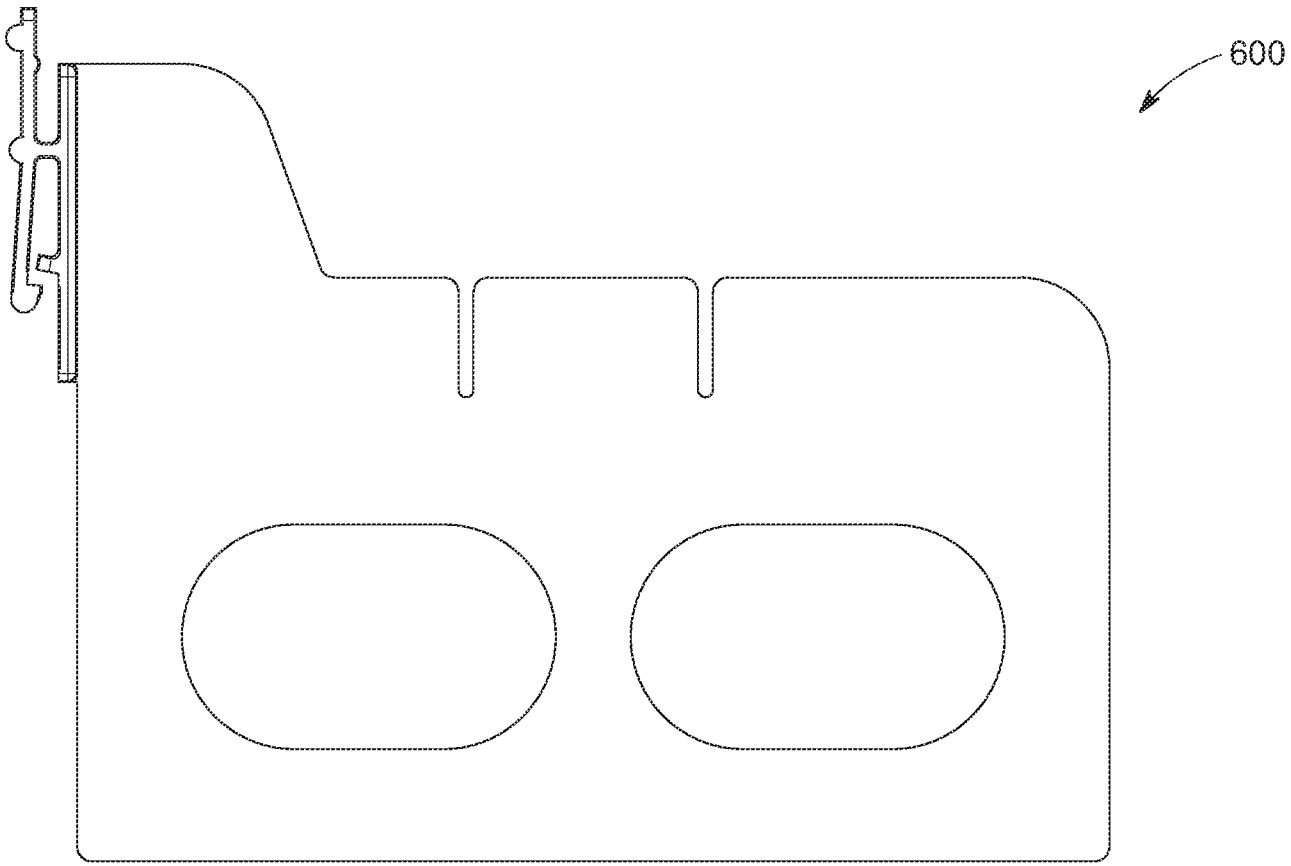
FIG. 7B is a side view illustrating the insert of FIG. 7A.

A plurality of different insert attachment mechanisms are supported allowing a wide variety of different insert types and sizes to be used with a single caddy. For example, FIGS. 2A-2B, 3A-3B and 7A-7B illustrate of inserts that utilize one embodiment of attachment mechanism in the form of a rearwardly-facing clip configured to be selectively attached to the rear wall of a storage device via an elongated opening in the rear wall of the device. The insert of FIGS. 2A-2B is used to add hang bars to the caddy while the insert of FIGS. 7A-7B is a divider that can be used to separate the interior storage area of the caddy into different compartments.

Figure 4A:
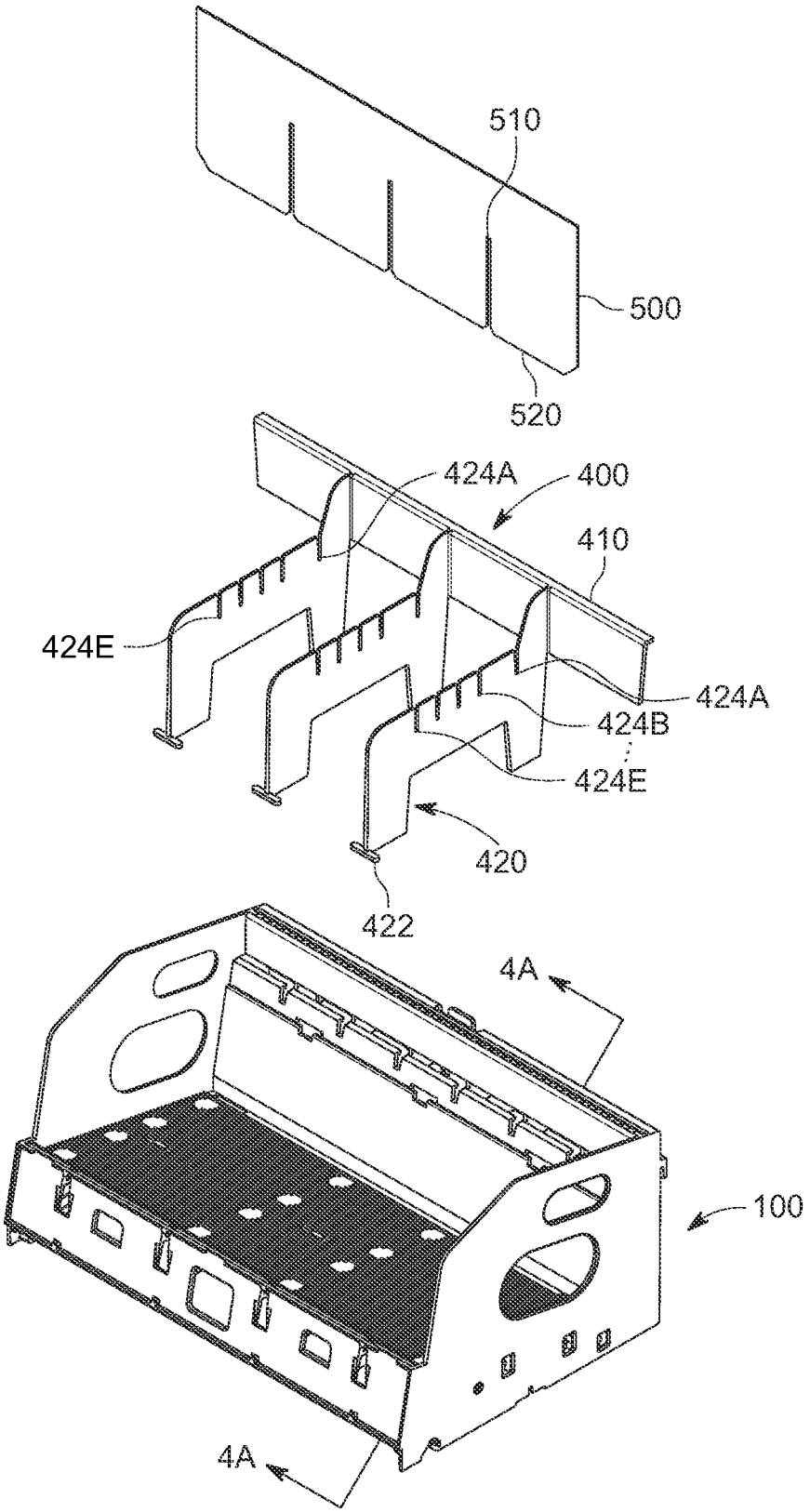
FIG. 4A is an exploded perspective view illustrating a storage system of the present invention that includes the storage device of FIG. 1A.
Figure 4B:
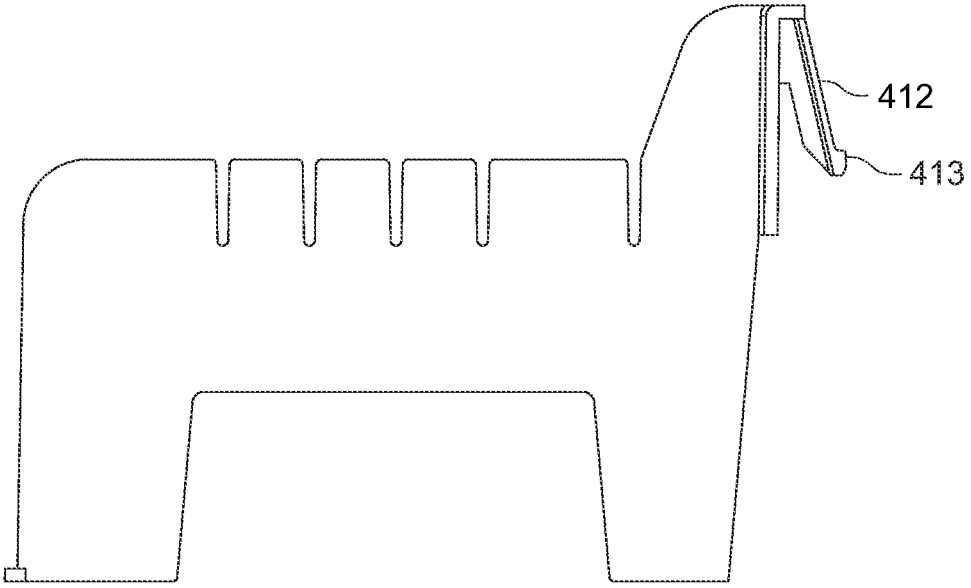
FIG. 4B is a side view illustrating an insert of the storage system of FIG. 4A.
Figure 4C:
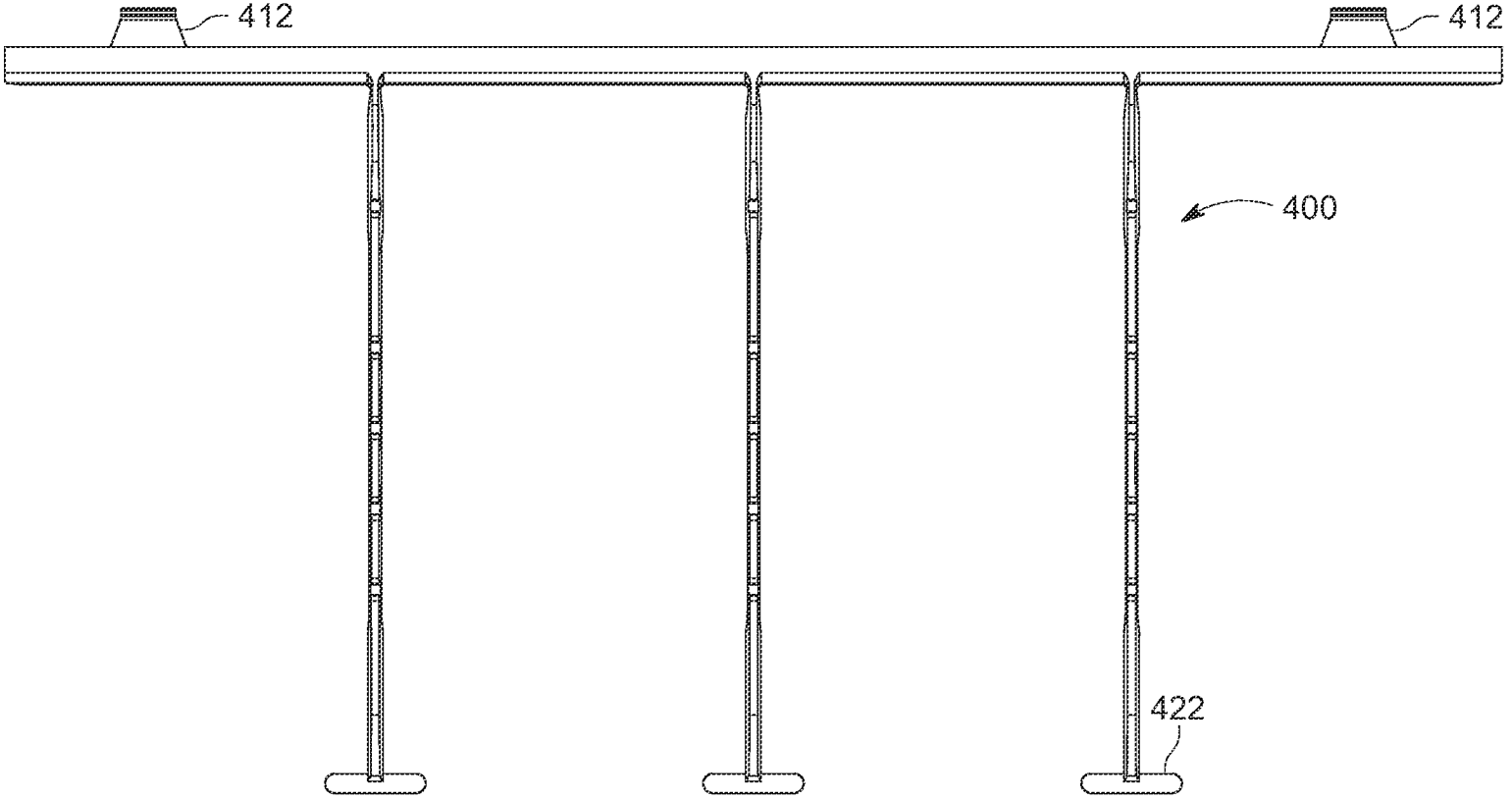
FIG. 4C is a top plan view illustrating the insert of FIG. 4B.
Figure 4D:
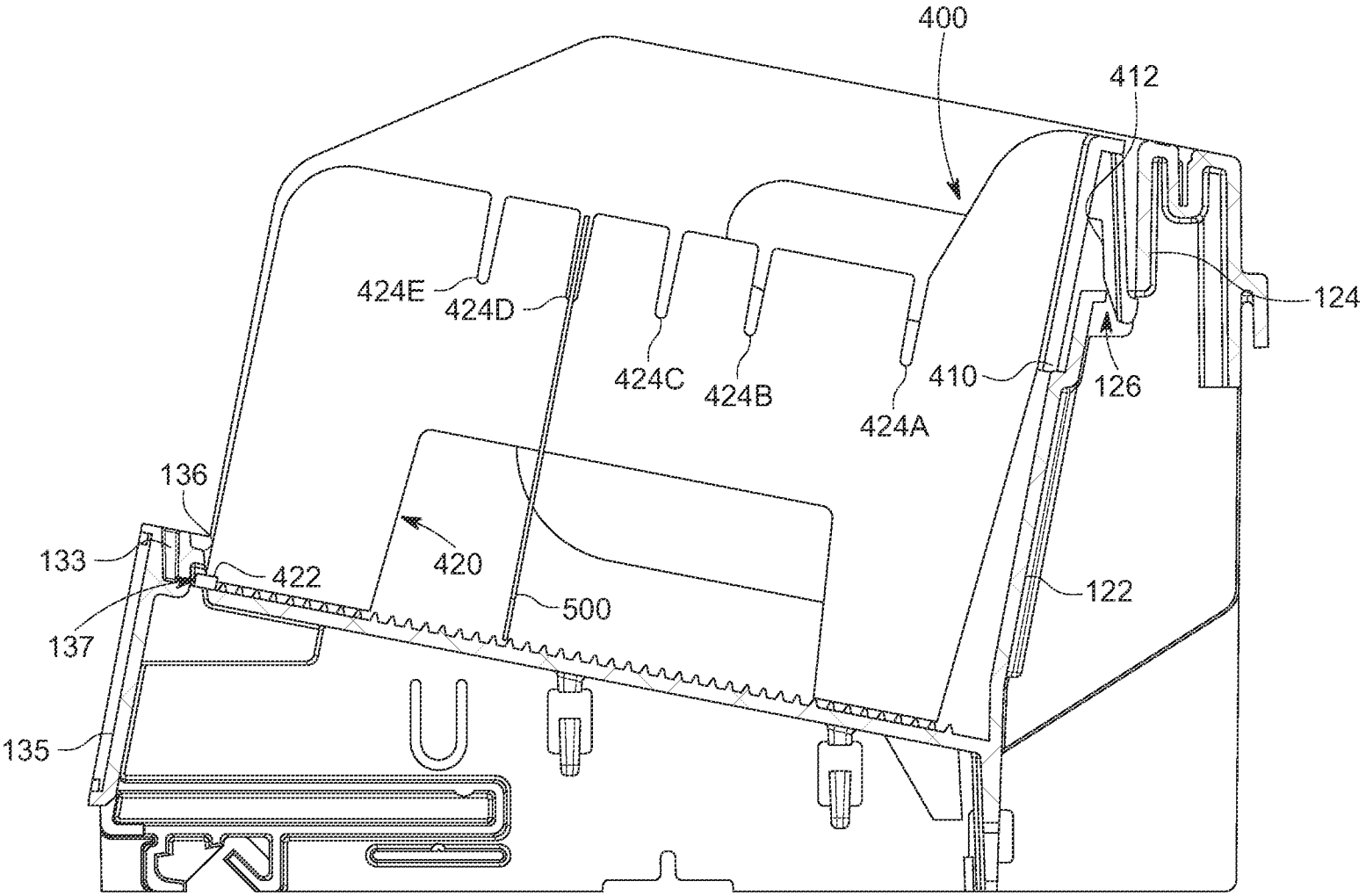
FIG. 4D is a cross-sectional view taken along line 4A-4A of FIG. 4A, illustrating the storage system of FIG. 4A in an assembled state.
Figure 5:
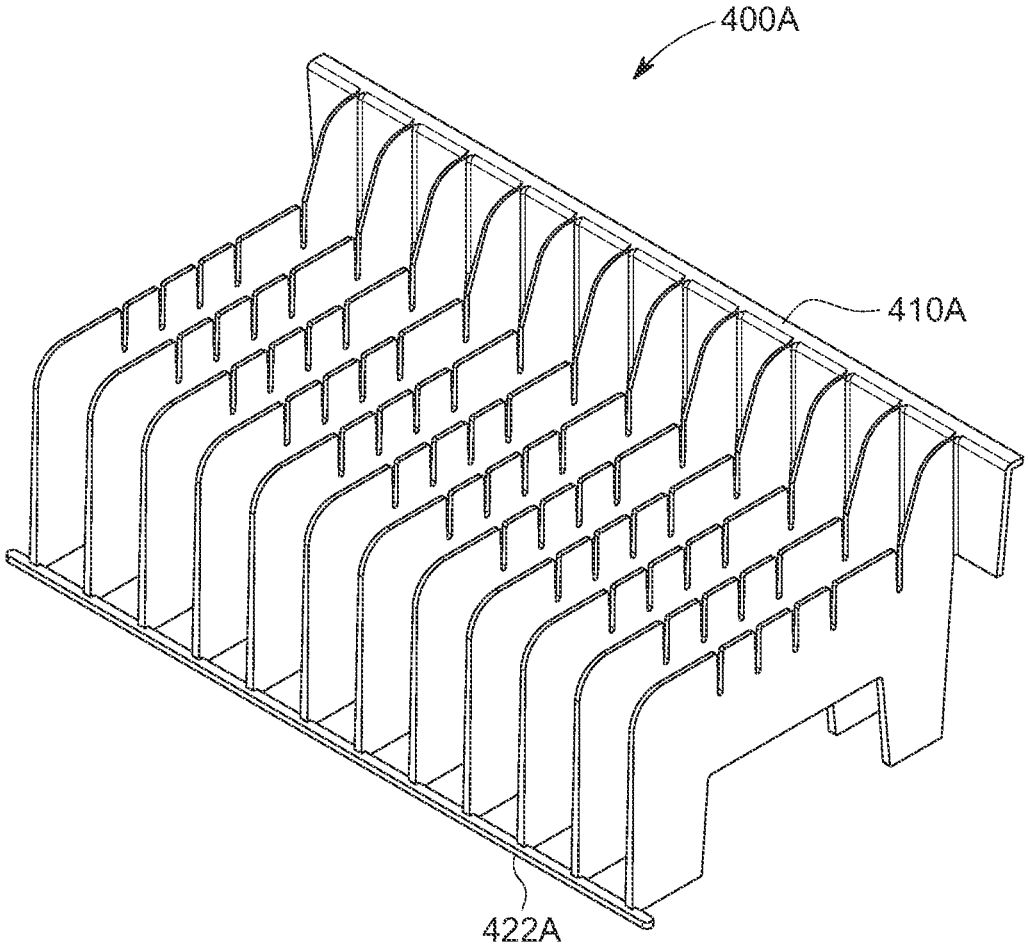
FIG. 5 is a perspective view illustrating an insert that is configured to be selectively coupled to the storage device of FIG. 1A.
Figure 6:
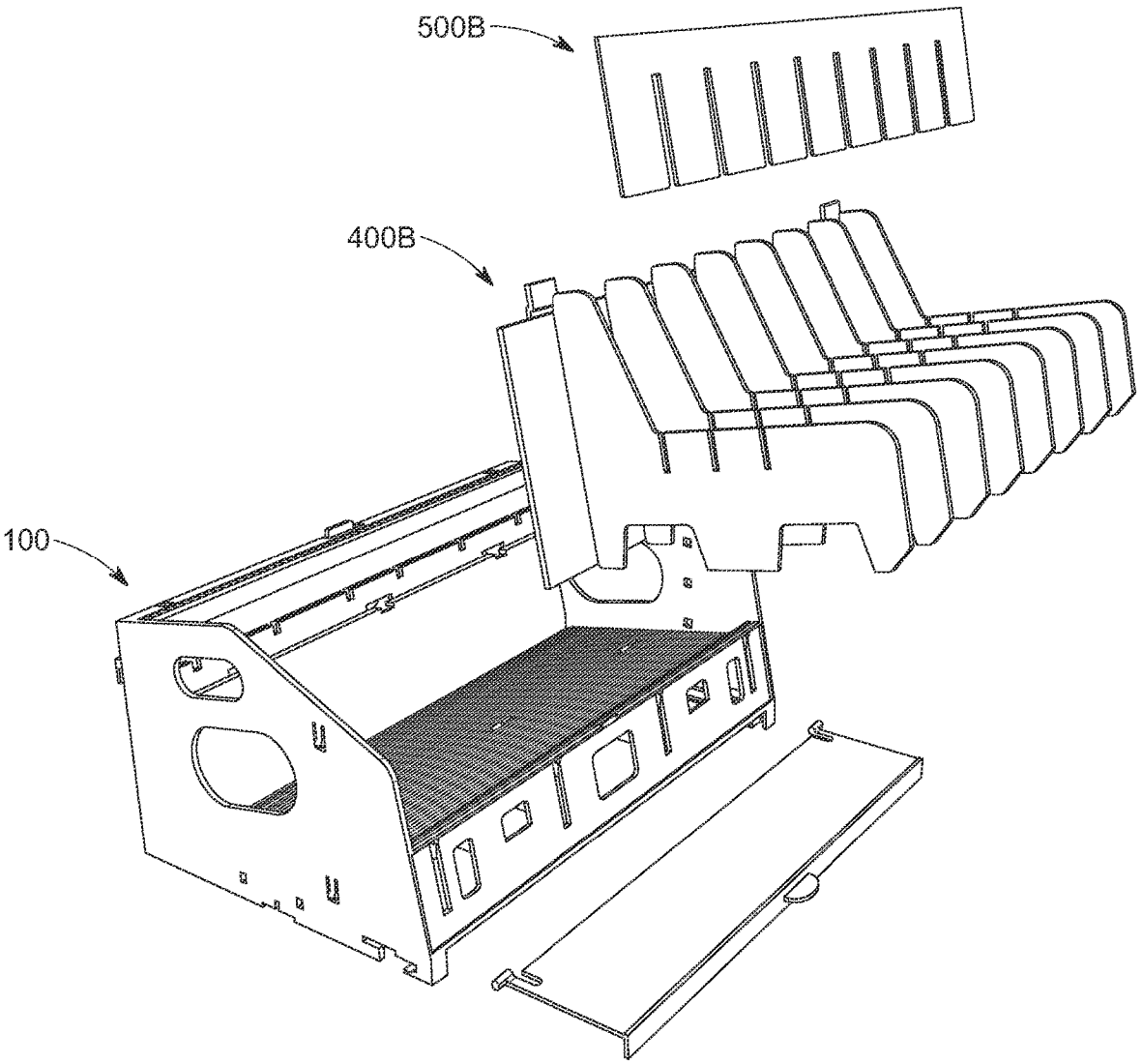
FIG. 6 is an exploded perspective view illustrating a storage system of the present invention that includes the storage device of FIG. 1A.

FIGS. 4A-4D and 5 illustrate an alternative attachment mechanism in which inserts selectively connect to both the front and rear walls of the storage device. The connection mechanism on an insert comprises a back wall with a pair of clips that engage the same elongated opening in the rear wall of the storage device as the clips of FIGS. 2A-2D. In addition, these inserts has a front end with one or more bar-shaped members that engage insertion slots at the front wall of the storage device and operate to secure the front end of the inserts to the front wall of the storage device. In a variation of this embodiment, and as shown in FIG. 6, the front bar-shaped member(s) can be omitted. Yet a further attachment configuration is shown in FIGS. 8A-8B and FIGS. 9A-9B in which dividers selectively connect to the front wall of the storage device similarly to the inserts of FIGS. 1A-5, but also have a back wall with a plurality of protrusions that are insertable in elongated through openings in the rear wall of the storage device.

FIGS. 10-15 illustrate yet another group of inserts that are configured to selectively connect between the front and rear walls along the base of caddy and maintain position by means of an inwardly-deflecting upside down "V"-shaped elastic clip that presses against the rear wall of the caddy to secure the insert in place above the bottom wall of the storage device.

FIGS. 16A-16C and 17 illustrate different kinds of brackets that can be selectively mounted to the storage device for hanging the storage device on a pegwall, an urbanwall, or other kind of load-bearing wall for storing and displaying the stored items at a desired location.

A more detailed description of the storage device, the inserts and the brackets of the present invention will now follow.

FIGS. 1A-1E illustrate a shelving device 100 according to an exemplary embodiment of the present invention. The shelving device 100 may also be referred to as a storage device, a caddy, a shelving unit, a shelving device, etc. Referring to FIG. 1A, the shelving device 100 includes a bottom wall 110, a rear wall 120 connected to a first side of the bottom wall 110, a front wall 130 connected to a second side of the bottom wall 110, opposite to the rear wall 120, a first sidewall 140 connected to the rear wall 120, the front wall 130 and to a third side of the bottom wall 110, and a second sidewall 150 connected to the rear wall 120, the front wall 130, and a fourth side of the bottom wall 110, opposite to the first sidewall 140. As illustrated in FIG. 1A, the walls of the shelving device 100 can include a plurality of through openings 132, 134, 142, 144, 152, 154 in order to reduce the weight of the device 100. The device 100 may be made of, for example, a polymeric material (e.g., a plastic material including, but not limited to acrylonitrile butadiene styrene (ABS)), a metal, or other materials know to those of skill in the art. When utilizing a polymeric material, the device 100 may be formed, for example, by injection molding. Due to the specific configuration of the device 100 as described in this specification, the device 100 can be injection molded in one manufacturing step.

The walls 110-150 of the device 100 define an interior area of the device 100 in which items can be placed for display. As disclosed herein, various display organizing inserts can be attached to the walls and base of the device 100 to allow for a wide variety of product display configurations.

Figure 1C:
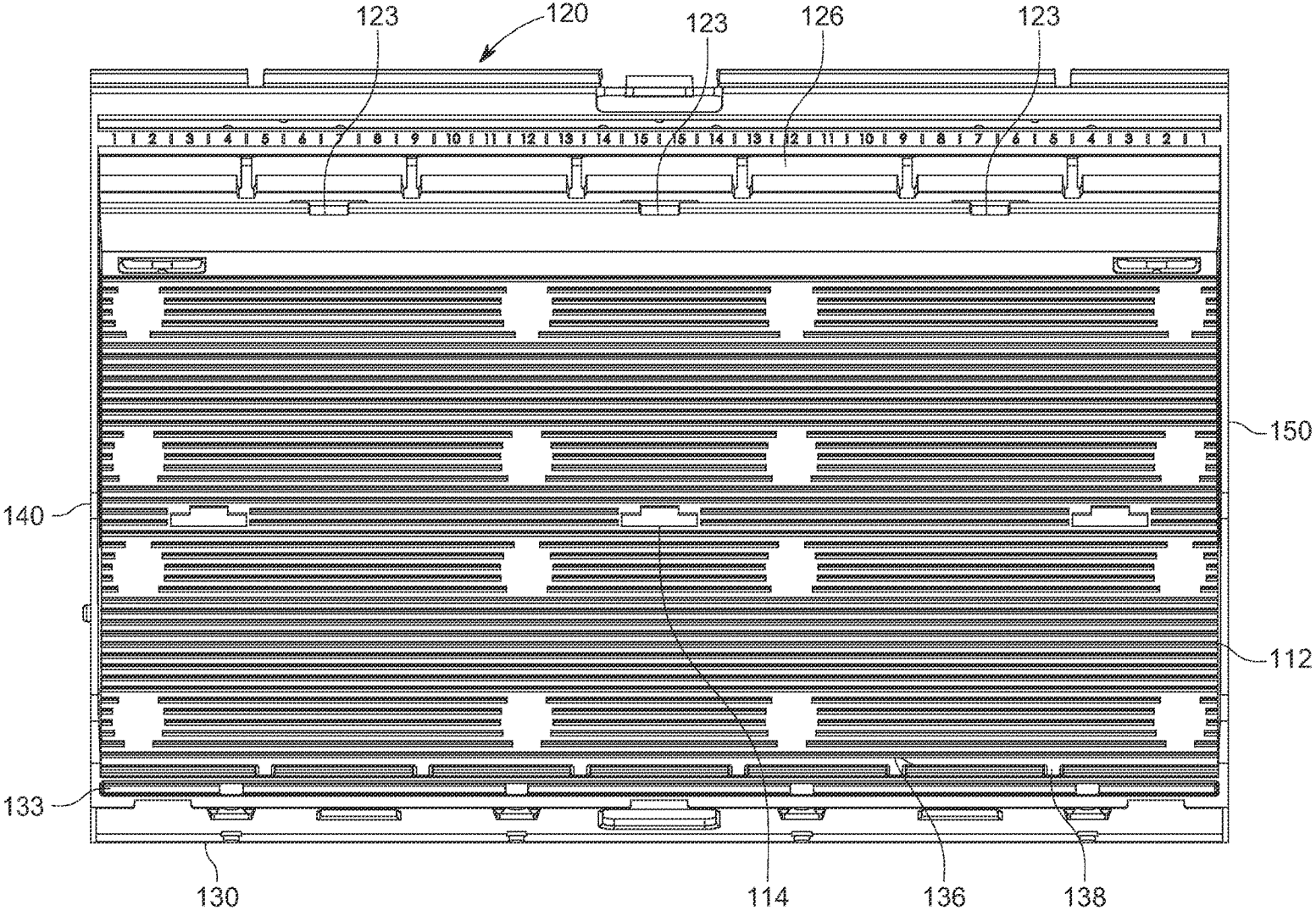
FIG. 1C is a top plan view illustrating the storage device of FIG. 1A.
Figure 1D:
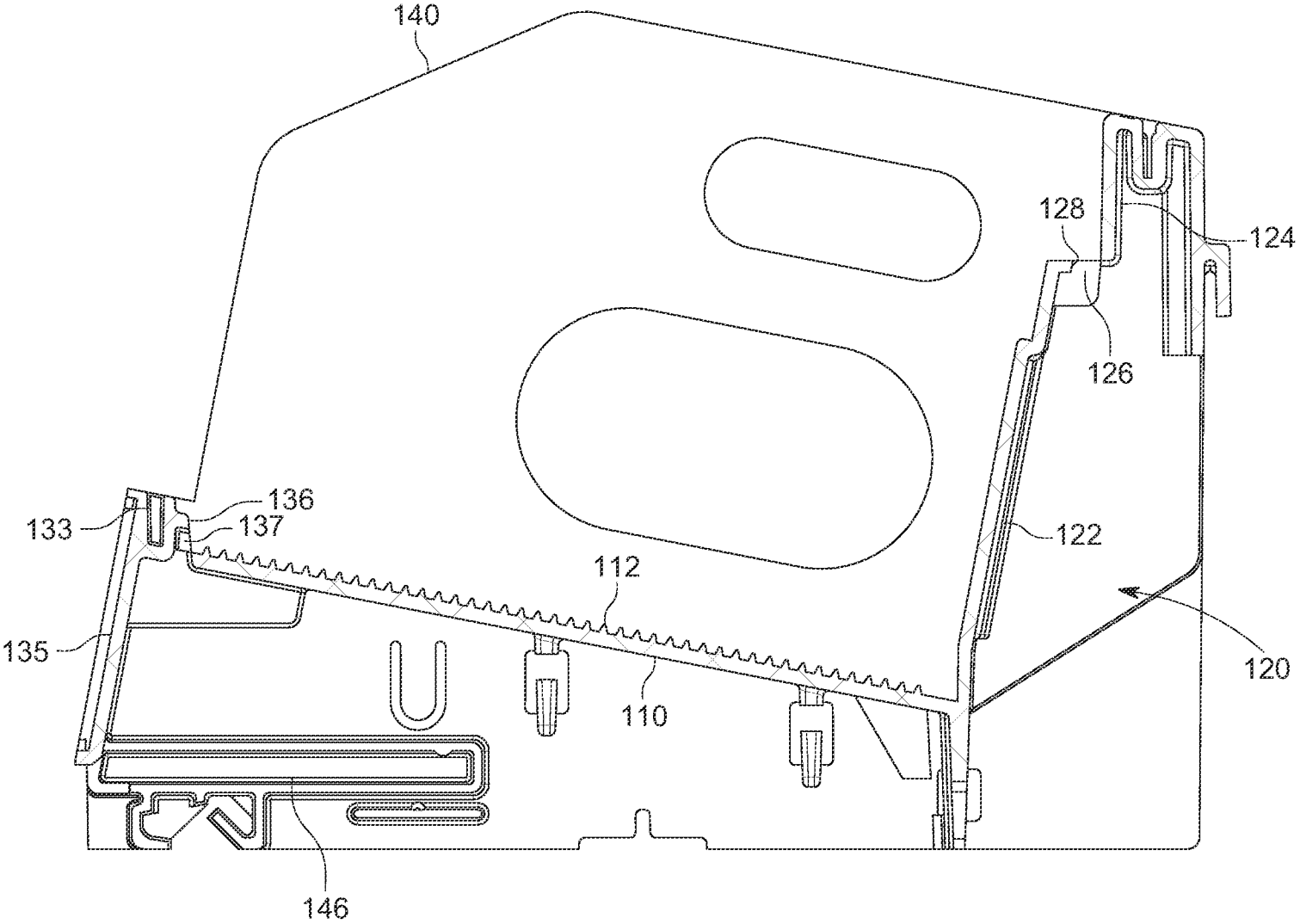
FIG. 1D is a cross-sectional view taken along line 1A-1A of FIG. 1B.
Figure 1E:
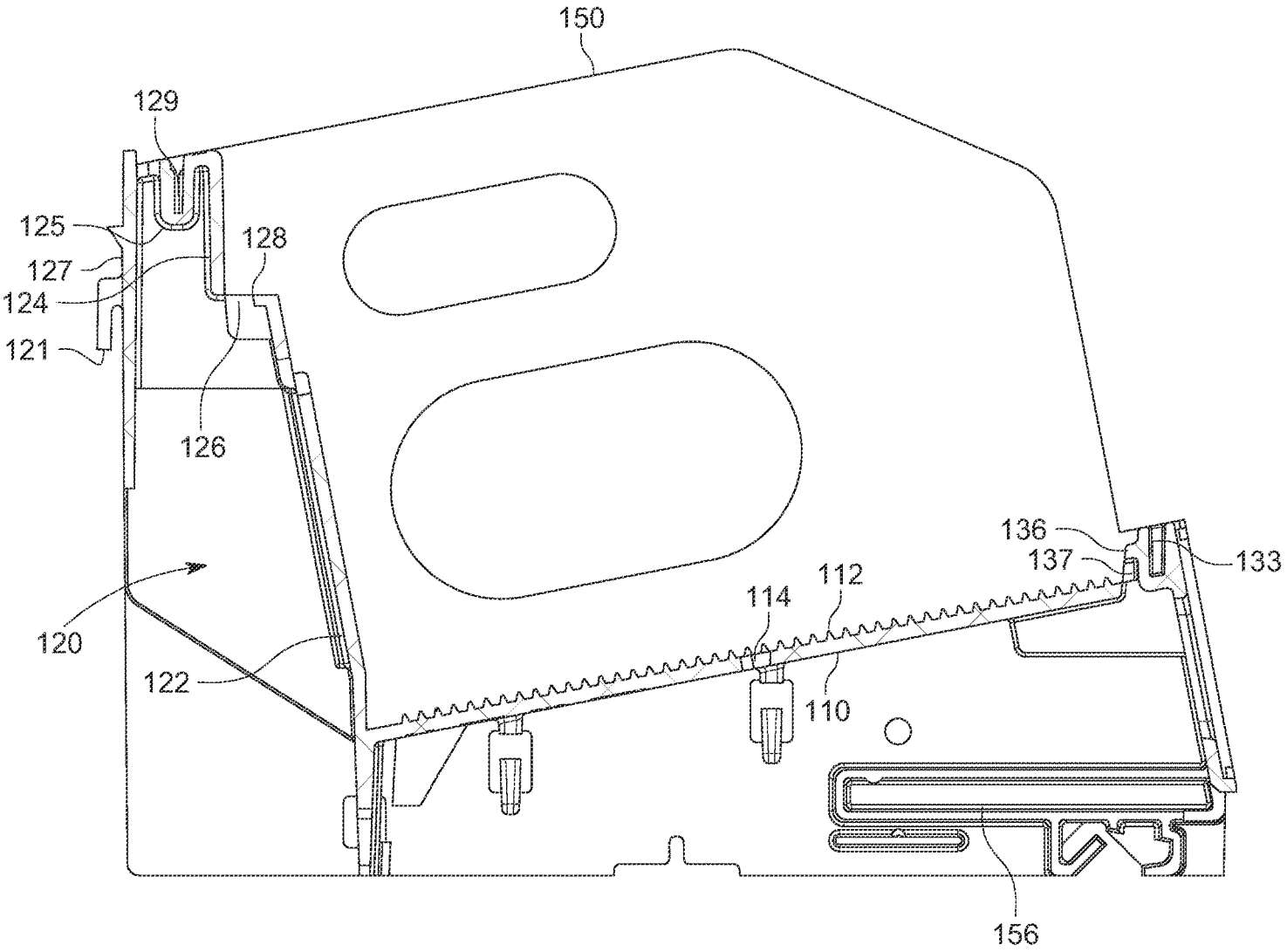
FIG. 1E is a cross-sectional view taken along line 1B-1B of FIG. 1B.

Referring to FIGS. 1C, 1D and 1E, the bottom wall 110 may include a plurality of ridges 112 extending between the first and second sidewalls 140 and 150, and a plurality of through openings 114. Ridges 112 can help retain the position of the bottom edge of a lateral wall insert that may be placed (such as insert 500B shown in FIG. 6). Referring to FIGS. 1A, 1D and 1E, the rear wall 120 of the device 100 includes a lower wall section 122 that extends between the first and second sidewalls 140 and 150, an upper wall section 124 that extends between the first and second sidewalls 140 and 150, a gap 126 separating the lower and upper wall sections 122 and 124 along their respective lengths, a back wall section 127 disposed at a rear end of the of the device 100 and extending between the first and second sidewalls 140 and 140, an elongated U-shaped wall section 125 that defines an elongated groove 129 along the length of the wall section 125 between the first and second sidewalls 140 and 150 of the device 100, and an "L"-shaped protrusion 121 (oriented downwardly in said FIGS.) connected to the back wall section 127. An upper end of the lower wall section 122 may include a lip 128 protruding toward the upper wall section 124 (and away from the front wall 130). The gap 126 may receive connectors from different kinds of inserts to attach the inserts to the rear wall 120.

The "L"-shaped protrusion 121 may be used to selectively connect the device 100 to a structural load bearing wall. Protrusion 121 can engage an elongated upwardly-oriented mating protrusion configured to enter in the space between the L-shaped protrusion 121 and the back wall 127. As will be described below, instead of the L-shaped protrusion 121 brackets of different configurations may be utilized to selectively attach the device 100 to a load-bearing wall.

Referring to FIGS. 1C, 1D and 1E, the front wall 130 may include a plurality of lip sections 136 (see FIG. 1C) protruding toward the rear wall 120 and having a length in a direction between the first and second sidewalls 140 and 150, an elongated recess 133 that extends between the first and second sidewalls 140 and 150 (see FIGS. 1C and 1D), and a recessed frontal surface area 135 (see FIG. 1A). As illustrated in FIGS. 1C, 1D and 1E, the lip sections 136 are separated from one another in the length direction by a plurality of gaps 138 (see FIG. 1C).

The overlapping region between each lip section 136 the top surface of the bottom wall 110 defines a plurality of insertion slots 137 (see FIG. 1D) between the first and second sidewalls 140 and 150. The slots 137 may be used to accommodate lateral bar-shaped components (or elongated protrusions) which can be present on various insert embodiments (as will be described below) in order to selectively couple the inserts with the front wall 130.

The frontal surface area 135 may be used as a display area in order to adhere or affix a label thereon (or for printing and/or marking directly on the area 135) in order to provide information about the products/items that are already stored (and/or are intended to be stored) in the interior area of the shelving device 100.

The elongated recess 133 may be used for selectively affixing an additional wall-like structure to the top of the front. As illustrated in FIG. 1D, the elongated recess 133 may be disposed between the lip sections 136 and frontal surface area 135 of the front wall 130.

FIGS. 2A-2B illustrate a representative insert 200 according to an exemplary embodiment of the present invention. The insert 200 in this embodiment is configured with a hang bar to be used for hanging items over the bottom wall 110 at the interior area of the device 100. Other outward facing structures could be provided instead. The insert 200 is selectively connectable to the rear wall 120. The insert 200 may be referred to as a hang bar.

Referring to FIG. 2A, the hang bar 200 may include a first structural component or wall 210 extending upwardly in a Z direction and along the X plane (with a recess 212 extending generally in a direction X), a second structural component or wall 220 connected to the first component 210 along its length and extending generally in the Z direction and along the Y plane, a third structural component or hang bar 230 is connected to the first and second components 210 and 220 and extending away from the first and second structural components 210 and 220 in the direction X. The hang bar 230 may include a plurality of protrusions 232 in order to separate items that are hung over the length of the component 230 from one another (see FIG. 2A).

coupler 240As illustrated in FIG. 2A, the X and Z directions may cross one another and may be, for example, perpendicular to one another. With reference to FIG. 2A, the X and Y directions may also cross one another, and may be, for example, perpendicular to one another A coupler 240 is connected to the rear of the second component 220 210. Referring to FIGS. 2A and 2B, the coupler 240 may include a coupling component 242 (which may be referred to as a clip 242 or elongated component 242) extending substantially in the Z direction (for example, parallel to the second component 220) and being spaced apart from the second component 220, a spacer component 244 connecting the coupling component 242 with the second structural component 220, a member 246 protruding from a lower end of the coupling component 242 toward the second structural component 220, a protrusion 243, and a member 248 protruding from the second structural component 220 toward the coupling component 242. As illustrated in FIGS. 2A and 2B, the member 248 may be disposed above the member 246 in the Z direction (in the orientation of FIG. 2B). The members 246 and 248 may also be referred to as protrusions.

Figure 3A:
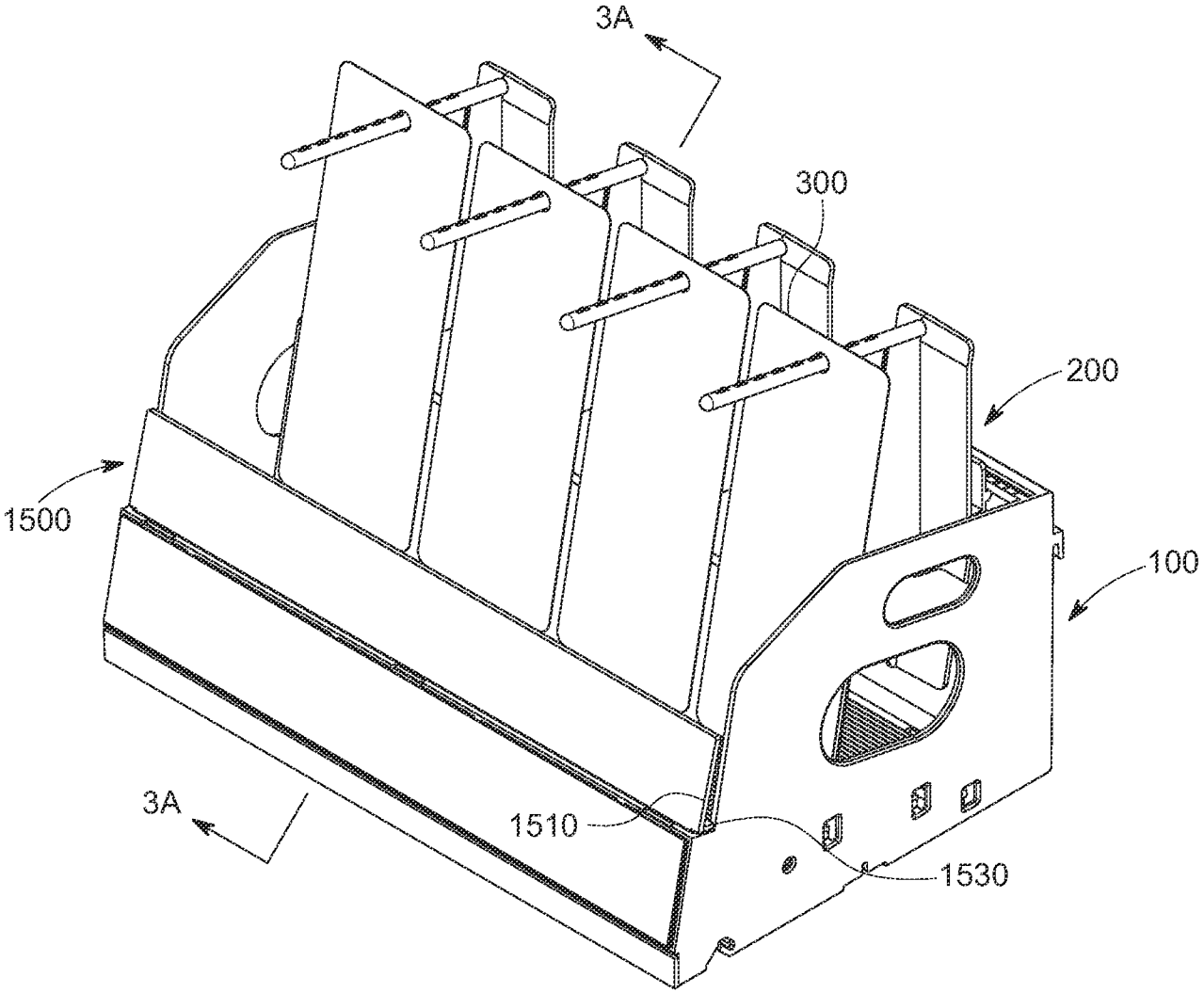
FIG. 3A is a perspective view illustrating a storage system of the present invention that includes the storage device of FIG. 1A.
Figure 3B:
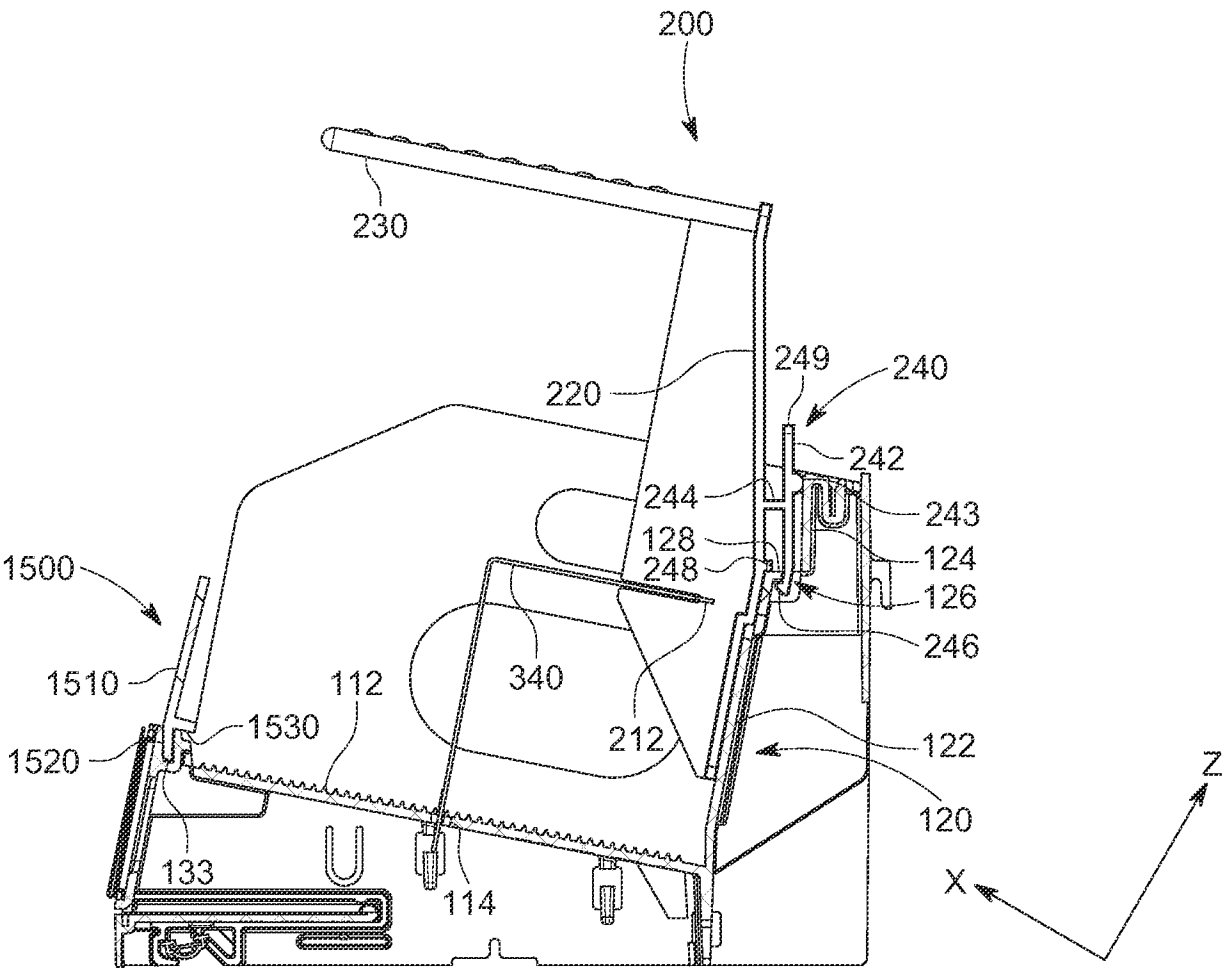
FIG. 3B is a cross-sectional view taken along line 3A-3A of FIG. 3A.

FIGS. 3A-3B illustrate a storage system including the shelving device 100 selectively coupled with a plurality of hang bars 200, and a front panel 1500, among other components. Referring to FIGS. 3A-3C, the hang bars 200 are exemplarily illustrated as being loaded with items 300Referring to FIG. 3C, the shape of a lower portion of the second structural component 220 of the hang bar 200 complements the shape of the lower wall section 122 of the rear wall 120. Therefore, these parts may sit flush against one another.

In the connected state, as illustrated in FIG. 3B, a lower portion of the second structural component 220 of the hang bar 200 rests against the lower wall section 122 of the rear wall 120 with the coupler 240 of the hang bar 200 being engaged with the lower wall section 122 of the rear wall 120. More specifically, in the coupled state the lower end of the coupling component 242 extends through the gap 126 in the rear wall 120 such that the protrusion 246 can engage the lip 128 from below in the orientation of FIG. 3B. In this state, the protrusion 243 of the coupler 240 rests against the upper wall section 124 of the rear wall 120 for structural support and stability purposes.

The protrusion 248 of the hang bar 200 may rest on the lip 128 of the lower wall section 122 in order to support the weight of the hang bar 200 and item(s) hung thereon. In addition, the step-like cross-section of the lower wall section 122 of the rear wall 120 may also contribute to supporting the weight of the hang bar 200 since the lower portion of the second structural component 220 of the hang bar 200 also has a matching step-like shape that sits flush on the lower wall section 122.

To remove the hang bar 200, a user would press an end 249 of the coupling component 242 toward the second structural component 220 in order to disengage the protrusion 246 of the hang bar 200 from the lip 128 of the rear wall 120. This enables the user to pull the hang bar 200 upwardly in order to selectively disconnect the hang bar 200 from the shelving device 100.

As further illustrated in FIG. 3B, a bracket or intermediate shelf 340 can be optionally and selectively connected to the hang bar 200, via the recess 212, and to the bottom wall 110, via at least one of the through openings 114 in the bottom wall 110 (see also FIG. 1C). The bracket 340 may extend longitudinally between the first and second sidewalls 140 and 150, and may span across substantially the entire length of the interior storage area of the device 100 between the first and second walls 140 and 150, or less than the entire length of said interior storage area. The bracket or shelf 340 may be used to, in order to orient the item 300 substantially perpendicularly with respect to the bottom wall 110 or to provide a partial back wall that can prevent product from sliding all the way to the back of the bar 230. The item 300 may also be disposed in a groove defined by two neighboring ridges 112 at the top surface of the bottom wall 110 for convenience and orderly arrangement of stored items.

Based on the disclosure above, the hang bars 200 can be easily and securely mounted to the shelving device 100 and can be easily disconnected therefrom. In addition, a user can elect to connect a desired number of hang bars 200 to the device 100, and the desired number may be less than the total number of hang bars 200 that the device 100 can receive. This is advantageous in cases when, for example, a user seeks to utilize only a part of the shelving device 100 for hanging items from above via one or more hang bars 200, and utilize the remainder of the interior area of the shelving device 100 for storing/stacking items on the bottom wall 110. The same mounting clip configuration 240 can also be used to attach other types of inserts as discussed further herein.

While FIGS. 3A-3B illustrate that the shelving device 100 can be selectively coupled with four hang bars 200, this configuration is merely exemplary. The largest number of hang bars 200 that the shelving device 100 can selectively receive depends on the length of the of the rear wall 120 (in the direction between the first and second sidewalls 140 and 150), and the width of the second component 220 of each hang bar 200 in the direction Y (as illustrated in FIG. 2A), which may be set/varied as needed.

Referring to FIGS. 3A-3B, the front panel 1500 may be utilized to secure items that are stored in the interior storage area of the device 100 from inadvertently being knocked out of said interior storage area, and/or for being used as an area to indicate information concerning the items stored in the interior storage area of the device 100. Front panel 1500 may include an elongated plate-like component 1510, a first elongated protrusion 1520 extending from below the component 1510, and a second elongated protrusion 1520 connected to the components 1510 and 1520. The first elongated protrusion 1520 can be configured to be selectively inserted in the elongated recess 133 of the front wall 130 of the device 100 in order to secure the front panel 1500 onto the device 100.

FIGS. 4A-4D illustrate an insert 400 and a comb-like structure 500 that together are configured to be selectively mounted into the interior area of the shelving device 100 in order to compartmentalize said interior area. The insert 400 includes a back wall 410 extending in a first direction. A plurality of separating structures (or dividers) 420 are connected to the back wall 410 and extend therefrom, such as perpendicularly to the back wall 410. The dividers 420 may be evenly spaced along the length of the back wall or spaced in varying configurations and numbers.

Referring to FIGS. 4B-4D, the back wall 410 of the insert 400 may include a plurality of clips 412 extending downwardly from the top rear side of the back wall 410 (opposite to the side of the back wall 410 from which the dividers 420 extend) at a certain angle in a direction away from the dividers 420. Each one of the dividers 420 may include a body with a bar-shaped transverse member 422 disposed at a bottom end of the body of the divider, opposite to the back wall 410. One or more recesses 424A-424E can also be provided.

The pair of clips 412 and the bar-shaped members 422 may be used to selectively couple the insert 400 to the shelving device 100, and to selectively disconnect the insert 400 from the shelving device 400.

In order to selectively connect the insert 400 to the shelving device 100, a user inserts the bar-shaped members 422 of the insert 400 inside of the slots 137 (i.e., between the lip sections 136 of the front wall 130 and the top surface of the bottom wall 110) of the device 100 with a portion of the body of each divider 420 being inserted in a gap 138 of the front wall 130 (see FIG. 1C). This will selectively (and pivotally) connect the bar-shaped members 422 with the front wall 130 of the shelving device 100. The user can then rotate the insert 400 to move the clips 412 through the gap 126 in the rear wall 120 of the shelving device 100 and then press the insert 400 downwardly (e.g., toward the bottom wall 110) to complete the connection between the insert 400 and the shelving device 100.

In the connected state, as illustrated in FIG. 4D, the bar-shaped members 422 may be rotated in place but are prevented from being raised upwardly from the bottom wall 110 due to bar-shaped members 422 being inserted in the slots 137 of the device 100. Referring to FIG. 4D, the clips 412 may be elastically compressed against the upper wall section 124 of the rear wall 120 of the shelving device 100 (or bent by a certain degree toward the back wall 410 of the insert 400) when the insert 400 is selectively connected to the device 100. The compression pressure secures elastically deforms the clip and or the adjacent upper wall section 124 until it is fully seated, at which time the clip opens to secure a bottom lip 413 of the clip against the bottom surface of wall 134.

To remove the insert 400 from the shelving device 100, the clips 412 can be pressed inwardly toward the back wall 410 of the insert 400 and the insert rotated to lift the clips 412 upwardly (away from the bottom wall 110). Once that the clips 412 are disengaged from the rear wall 120, the the insert 400 can be pulled away from the front wall 130 of the shelving device 100 in order to disconnect the bar-shaped members 422 from the slots 137. This would complete the process of disconnecting the insert 400 from the shelving device 100.

As illustrated in FIGS. 4A-4D, the body of each divider 420 may include one more a plurality of recesses 424A-424E. The recesses 424A-424E in the bodies of the dividers 420 may be utilized to further compartmentalize (or subdivide) the four compartments that are formed by the three dividers 420 into the interior storage area of the device 100. This can be achieved by selectively coupling the comb-like structure 500 (see FIG. 4A) with the dividers 420 to provide lateral dividing walls. Slots or recesses 510 in the structure 500 can be formed so that the lateral dividing walls can easily extend down to the bottom surface of the caddy. Advantageously, the solid portion of the structure 500 that is located above the recesses 510 (relative to the arrangement illustrated in FIG. 4), may be slid inside the chosen row of recesses 424A-424E in order to prevent rotation of the structure 500 relative to the insert 400. This configuration is desirable because it ensures that the shape/size of the subdivisions created by the structure 500 will not change during use of the shelving device 100.

FIG. 4A illustrates only one device 500 in order to avoid cluttering the drawings. It is understood that more than one such device can be used in conjunction with the insert 400 in order to create a desired number of subdivisions within the shelving device 100. To this end, the dividers 420 of the insert 400 are illustrated as having only five recesses 424A-424E each, but the number of recesses in the dividers 400 can be varied as needed. For example, FIG. 5 illustrates an insert 400A. Insert 400A is similar to the insert 400 with the exception of the number of dividers included in the insert 400A and the fact that insert 400A includes a continuous bar-shaped member 422A as opposed to the individual bar-shaped members 422 of the insert 400. The In addition, as will be described below, the number of dividers (such as the dividers 420) in an insert can be varied as needed. FIG. 4A illustrates an insert 400 with three dividers, but the present invention is not limited to this configuration. For example, the number of dividers in an insert can be greater than three, or less than three.

FIG. 6 illustrates an example of an insert 400B that is configured to be selectively connected to the device 100. Unlike the inserts 400 and 400A, the insert 400B lacks any bar-shaped member(s) in a front region of the dividers, but has the same configuration with hooks in a rear end thereof, similarly to the inserts 400 and 400A. Therefore, the insert 40B is selectively connectable to the device 100 only through its two rear clips. FIG. 6 also illustrates a comb-like structure 500B that is configured to be connected to the insert 400B in order to further subdivide the interior area of the device 100. As illustrated, the structure 500B has a number of recesses that matches the number of dividers in the insert 400B.

FIGS. 7A-7B illustrate an insert 600 that is configured to be selectively coupled to the rear wall 120 of the device 100 similarly to the hang bar 200. Referring to FIG. 7A-7B, the insert 600 includes a coupler 240A and a divider 620 extending from the coupler 240A. The coupler 240A may have a similar configuration to that of the coupler 240 of the hang bar 200 and reference is made to the discussion above. The divider 620 is used to subdivide the interior area of the device 100. The divider 620 may have an elongated body with one or more recesses 624 and one or more through openings 620. The recesses 624 are configured to be selectively connected to an appropriately-sized comb-like structure, as described above. . The through openings 626 may be used to reduce the weight of the insert 600. One or more inserts 600 may be selectively coupled to a shelving device 100. In addition one or more inserts 600 can be combined with one or more hang bars 200 in the same shelving device 100. This configuration can provide increased storage solutions in a shelving device 100.

Figure 8A:
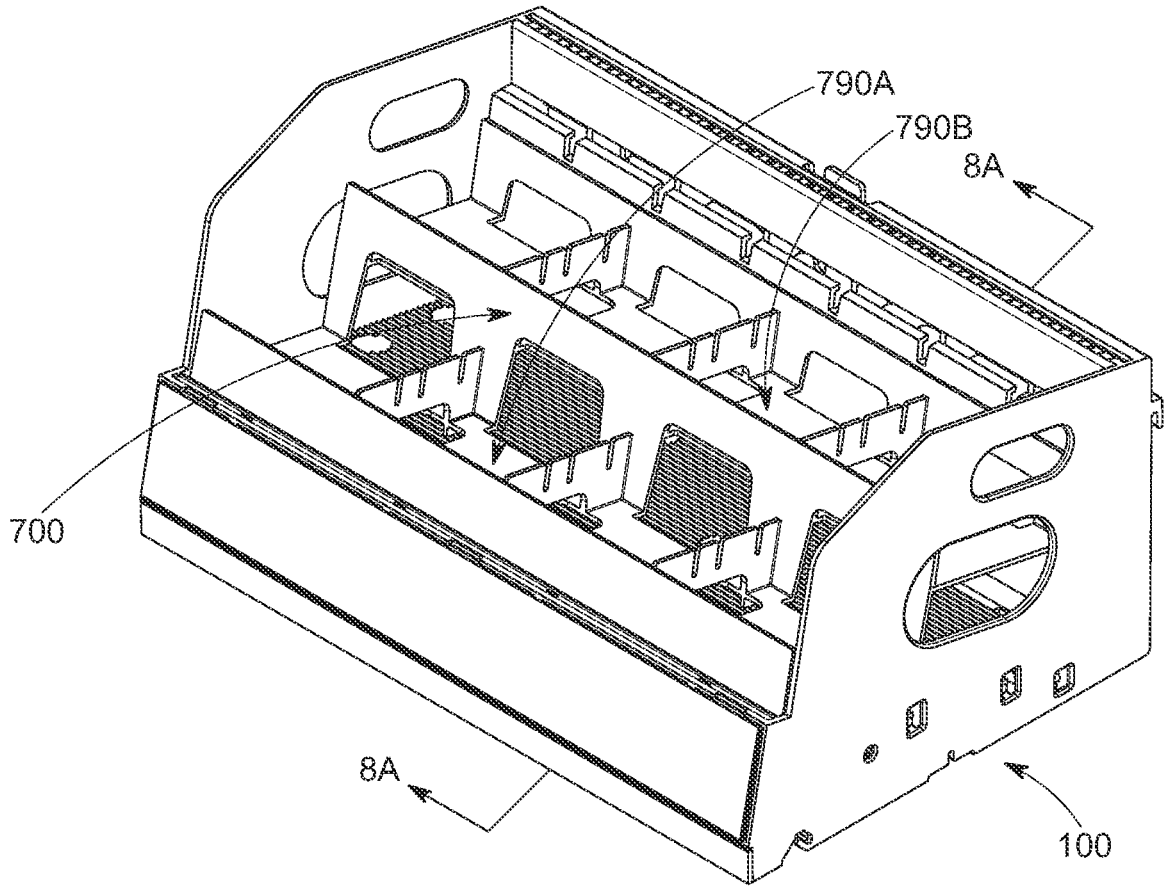
FIG. 8A is a perspective view illustrating a storage system of the present invention that includes the storage device of FIG. 1A.
Figure 8B:
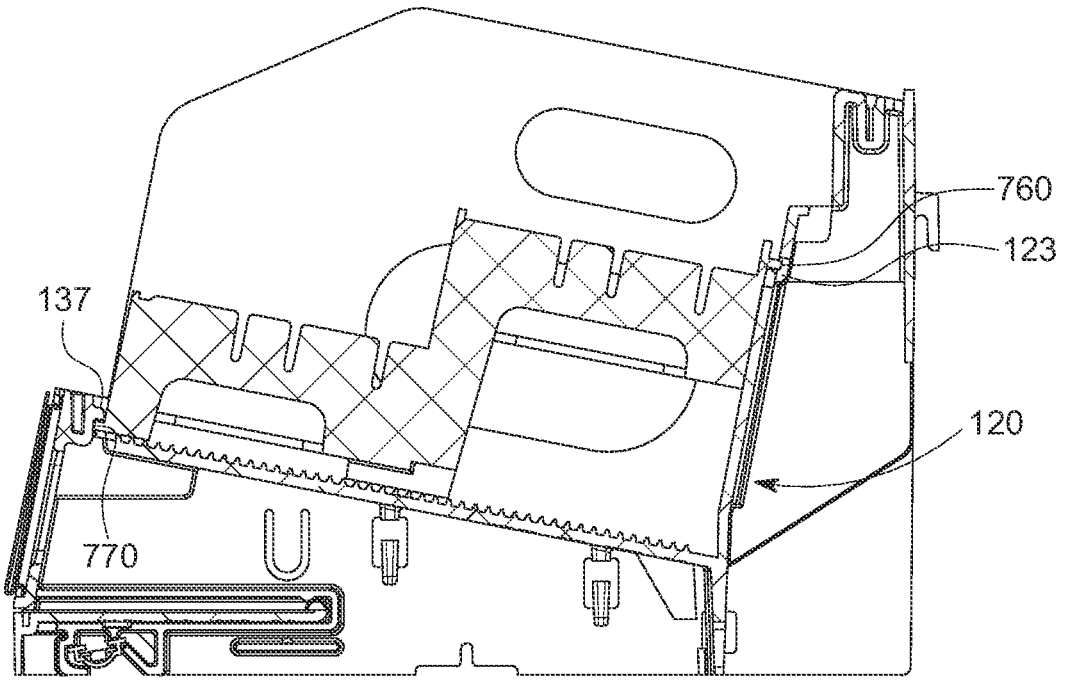
FIG. 8B is a cross-sectional view taken along line 8A-8A of FIG. 8A.

FIGS. 8A-8B illustrate an insert 700 with a plurality of multi-height rectangular-shaped compartments that can be selectively connected to the device 100 for compartmentalizing the interior area of the shelving device 100. The insert 700 includes a body 710 with a front wall 720, a rear wall 730, a middle wall 740, a plurality of dividers 750 disposed between the walls 730-750 and extending in a different direction, bottom sections 780A and 780B disposed at heights H1 and H2, respectively (see FIG. 8D), where H2 is greater in magnitude than H1, a bar-shaped member 770 extending protruding from a bottom of the front wall 720 along the length of the front wall 720, and a plurality (e.g., three) protrusions 760 extending from the rear wall 730 (see FIG. 8G). As illustrated in FIGS. 8A-8B, the insert 700 defines a plurality of compartments 790A and a plurality of compartments 790B that are disposed at a higher elevation than the compartments 790A. In other words, the insert 700 includes a first row of compartments 790A and a second row of compartments 790B at a different height than the first row.

To selectively connect the insert 700 to the interior area of the shelving device 100, the bar-shaped member 770 is inserted in the insertion slots 137 of the device 100 (adjacent to the front wall 130 of the device 100). Once the bar-shaped member 770 is inserted in the insertion slots 137, the insert 700 can be pivoted downwardly (e.g., toward the bottom wall 110 of the device 100) until the protrusions 760 enter and extend inside of the through openings 123 in the rear wall 120 of the device 100. See FIG. 8B, illustrating one of the protrusions 760 inserted and extending inside a corresponding one the through openings 123 in the rear wall 120. When the protrusions 760 enter and extend inside of the through openings 123 in the rear wall 120 of the device 100, the rear wall 730 of the insert 700 is disposed adjacent (and may contact) the rear wall 120 of the device 100, as illustrated in FIG. 8B. In this state, and as illustrated in FIGS. 8A-8B, the insert 700 is selectively connected to the device 100.

The insert 700 may be selectively disconnected from the shelving device 100 by first removing the protrusions 760 from the through openings 123 in the rear wall, and pulling the insert 700 upwardly to disconnect the rear wall 730 of the insert 700 from the rear wall 120 of the device 100. The bar-shaped member 770 of the insert 700 may then be ejected from the insertion slots 137 in the device 100.

Figure 8C:
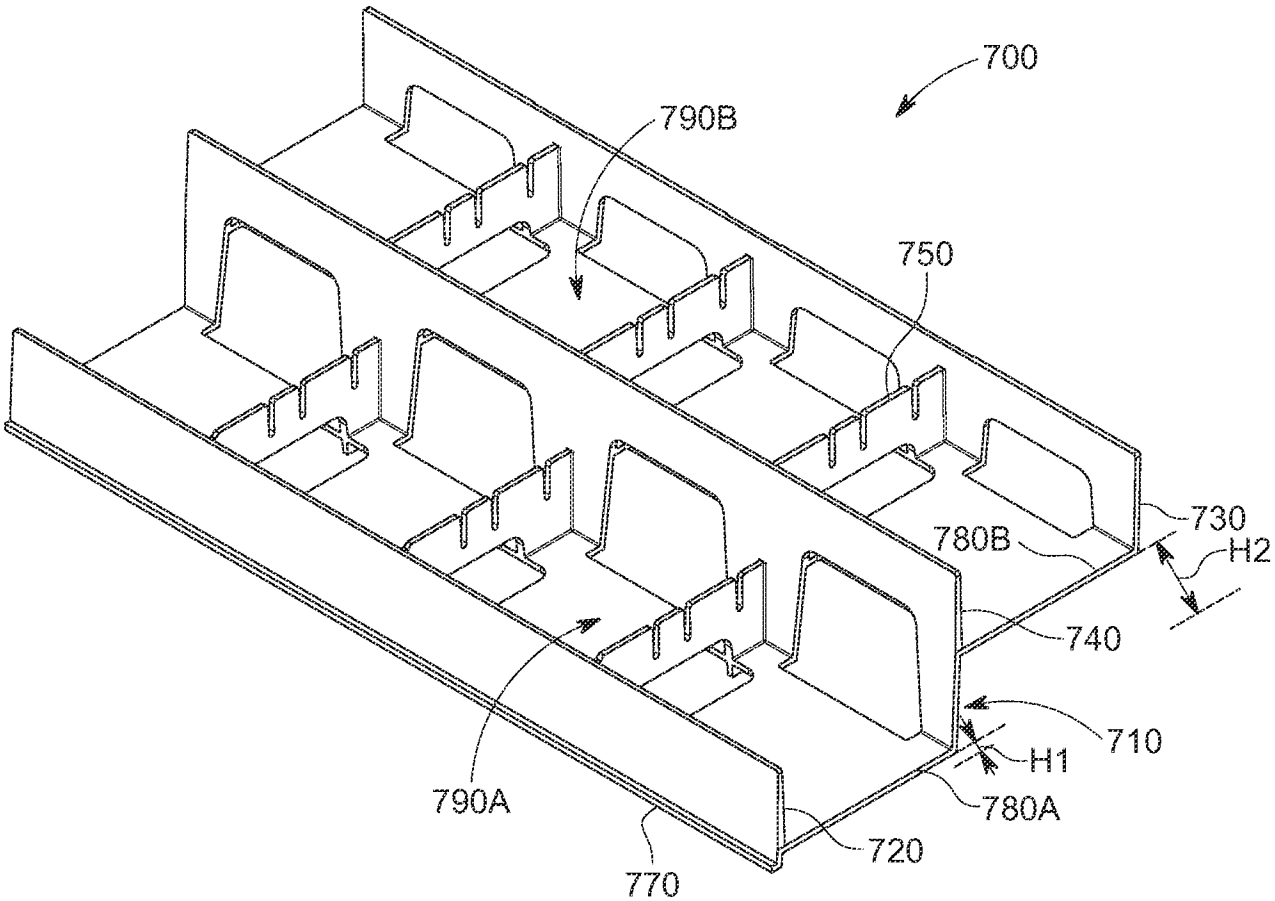
FIG. 8C is a perspective view of the insert of FIG. 8A*k*
Figure 9A:
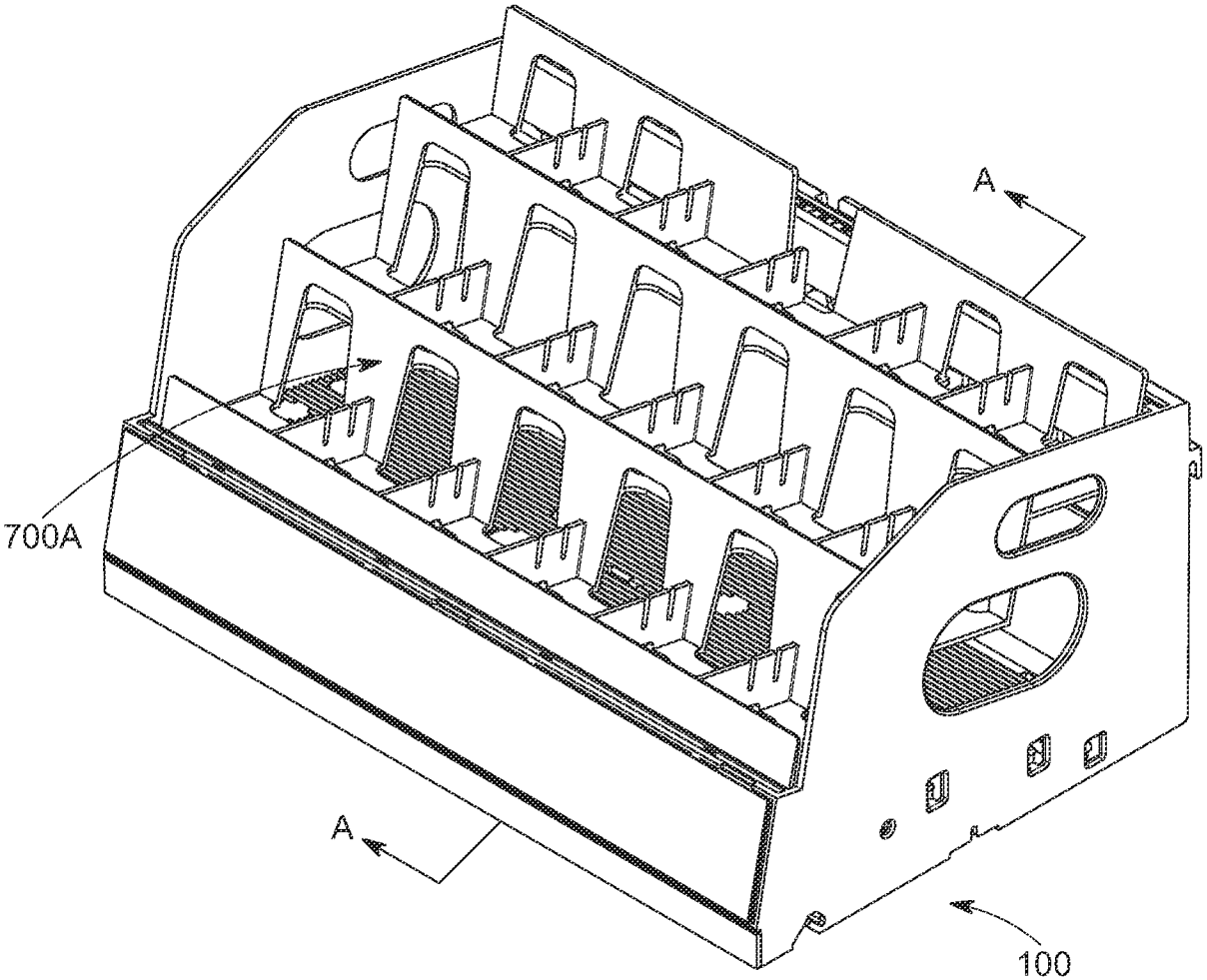
FIG. 9A is a perspective view illustrating a storage system of the present invention that includes the storage device of FIG. 1A.
Figure 9B:
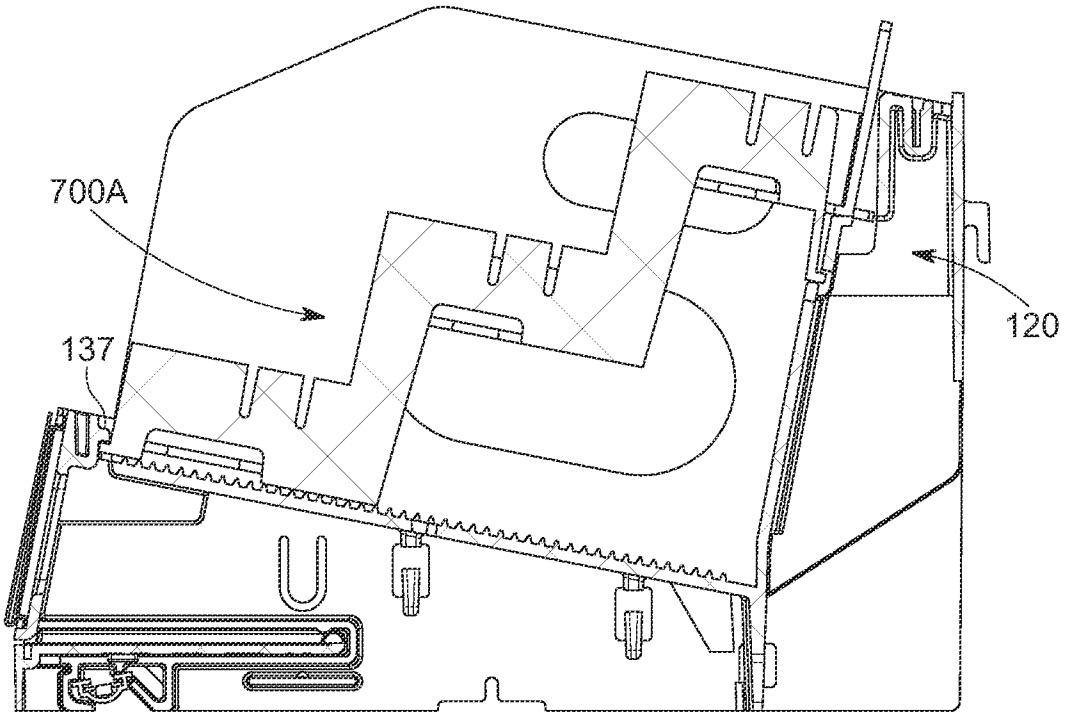
FIG. 9B is a cross-sectional view taken along line A-A of FIG. 9A.

FIGS. 9A-9B illustrate an insert 700A similar to that of insert 700 of FIGS. 8A-8C but with three tiers instead of two and a greater number of horizontal divided sections. a greater number of divided . The configuration of the insert 700A that allows it to be selectively connected to and disconnected from the device 100 in the same manner as that of the insert 700.

Figure 10:
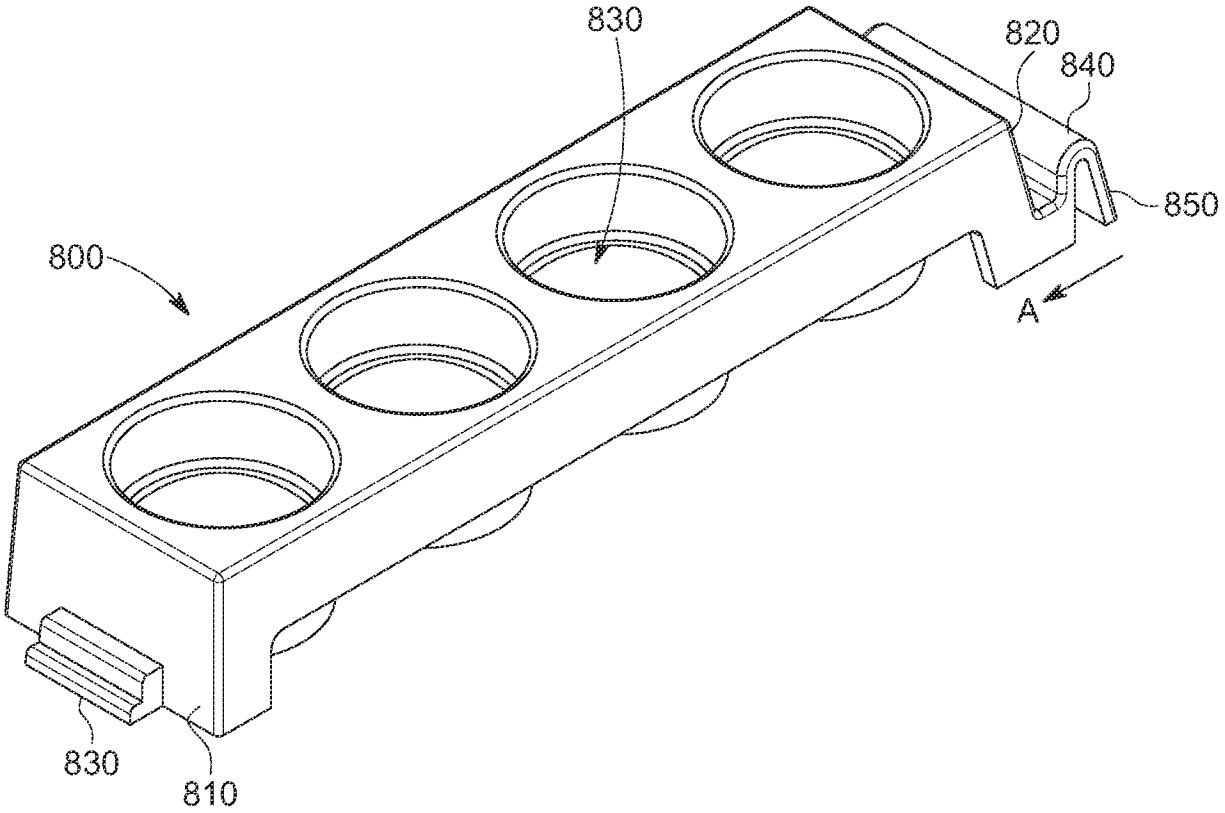
FIG. 10 is a top perspective view illustrating an insert that is configured to be selectively coupled to the storage device of FIG. 1A.

FIGS. 10 illustrates an elongated insert 800 that is configured to be selectively coupled to the interior area of the device 100. The elongated insert 800 is configured to be pressure-fit against the front and rear walls 130 and 120 of the device 100 when disposed directly over the bottom wall 110 of the device 100. The insert 800 is has an elongated body with a front wall 810, a rear wall 820, and a plurality of evenly spaced cylindrical storage areas 830 disposed between the front and rear walls 810 and 830 thereof. The front wall 810 includes a protrusion 830, and the rear wall 820 includes a flexible upside-down "V"-shaped clip 840 (which may simply be referred to as a "V" clip for brevity purposes, although the "V" is in an upside-down arrangement in normal use). The "V" clip 840 includes a distal component 850 that is configured to be flexed in the direction indicated by the arrow A in order to be brought close to the rear wall 820.

To press-fit insert 800 on the device 100 the insert 800 is disposed in the interior area of the device 100 with the front wall 810 of the insert 800 facing the front wall 130 of the insert 100, and the rear wall 820 of the insert 800 facing the rear wall 820 of the device 100. Then, the protrusion 830 at the front wall 810 of the insert 800 is inserted in one of the slots 137 of the device 100, adjacent to the front wall 130 thereof.

The end of the insert 800 that includes the rear wall 820 may then be pivoted downwardly and pressed toward the bottom wall 110 of the device 100. This causes the "V" clip 805 to contact the rear wall 120 of the device 100 and be compressed (e.g., with the distal component 850 of the "V" clip moving in the direction A, as illustrated in FIG. 10A). The rear end of the insert 800 is pressed downwardly until a bottom of the insert 800 lies flat against the bottom wall 110 of the device 100 (with the "V" clip in a compressed state). The pressure generated by compressing the "V" clip 840 against the rear wall 120 of the device 100 ensures that the insert 800 will be securely connected to the device 100.

This configuration is advantageous because it enables a rapid and secure way to selectively connect the insert 800 to the device 100 and to selectively disconnect the insert 800 from the device 100.

The insert of 800 if FIG. 10 provides a single row of holders, e.g., for lipstick or eye liner bottles. Multiple such inserts can be provided in a single caddy and these can be used in conjunction with other inserts, such as the divider walls shown in FIGS. 4, 5, and 6.

Figure 11:
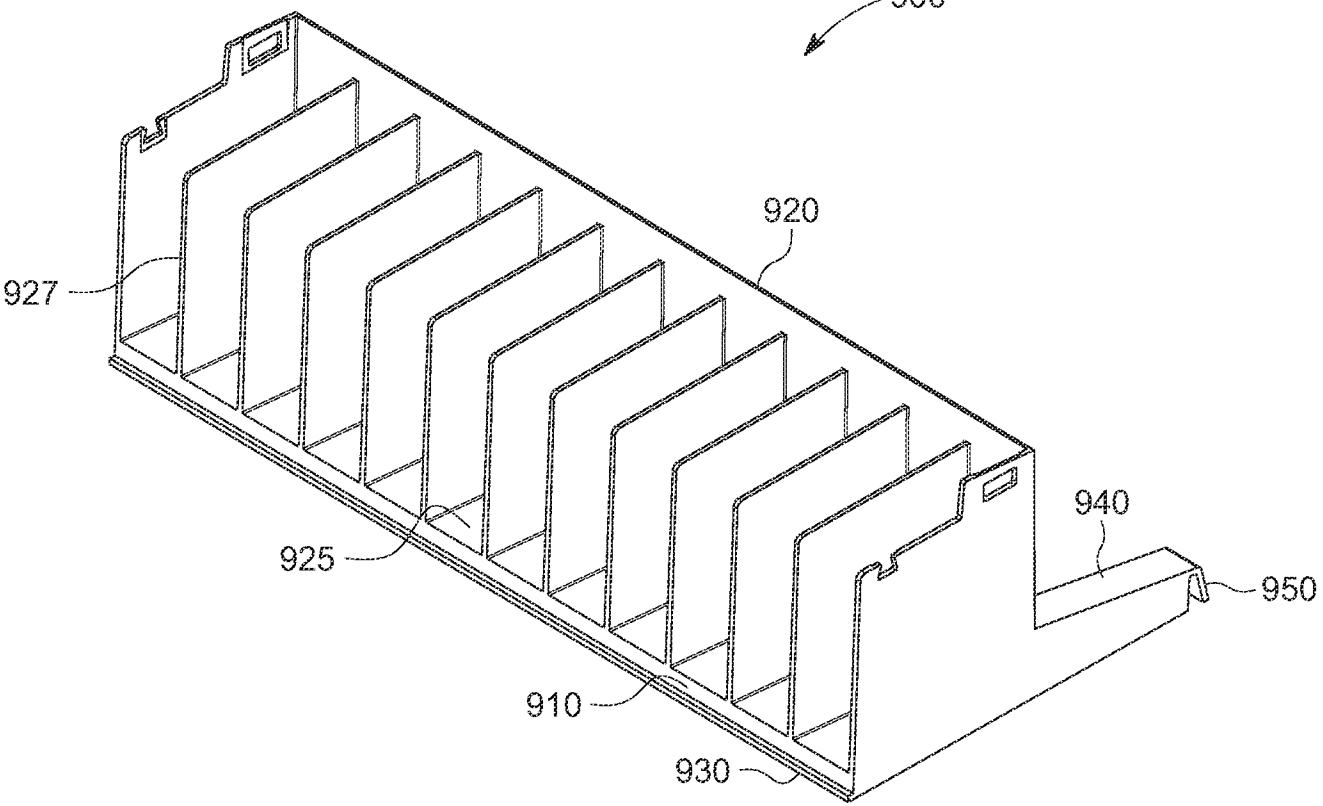
FIG. 11 is a perspective view illustrating an insert that is configured to be selectively coupled to the storage device of FIG. 1A.

FIG. 11 illustrates a press-fit insert 900 that operates on a similar manner to insert 800 of FIG. 10 but which is elongated laterally. Various structures can be formed on the insert. In the illustrated embodiment, a plurality of divider walls are present. The configuration of insert 900 enables the insert 900 to be press-fit in place in the interior area of the device 100 similarly to the insert 800.

Referring to FIG. 11 the insert 900 includes a body with a front wall 910 and a bar-shaped member 930 protruding from the front wall 910 along a length the front wall 910, a bottom wall 925, a rear wall 920, a plurality of compartment walls 927 connected to the bottom and rear walls 925 and 920, a pair of extension components 940 extending away from the rear wall 920, and a clip 950 extending away at a certain angle from each one of the extensions 940.

The insert 900 can be selectively coupled to the interior area of the device 100 by inserting the bar-shaped member 930 inside of the insertion slots 137 of the device 100 with the clips 950 facing the rear wall 120 of the device 100, and then pressing the insert 900 downwardly to compress the clips 950 against the rear wall 120 of the device 100 until the bottom wall 925 and the extension 940 the insert 900 contact the bottom wall 110 of the device 100.

In other words, the clips 950 function similarly to the "V" clips 840 to maintain the insert 900 securely compressed in place in the interior area of the device 100.

Figure 12:
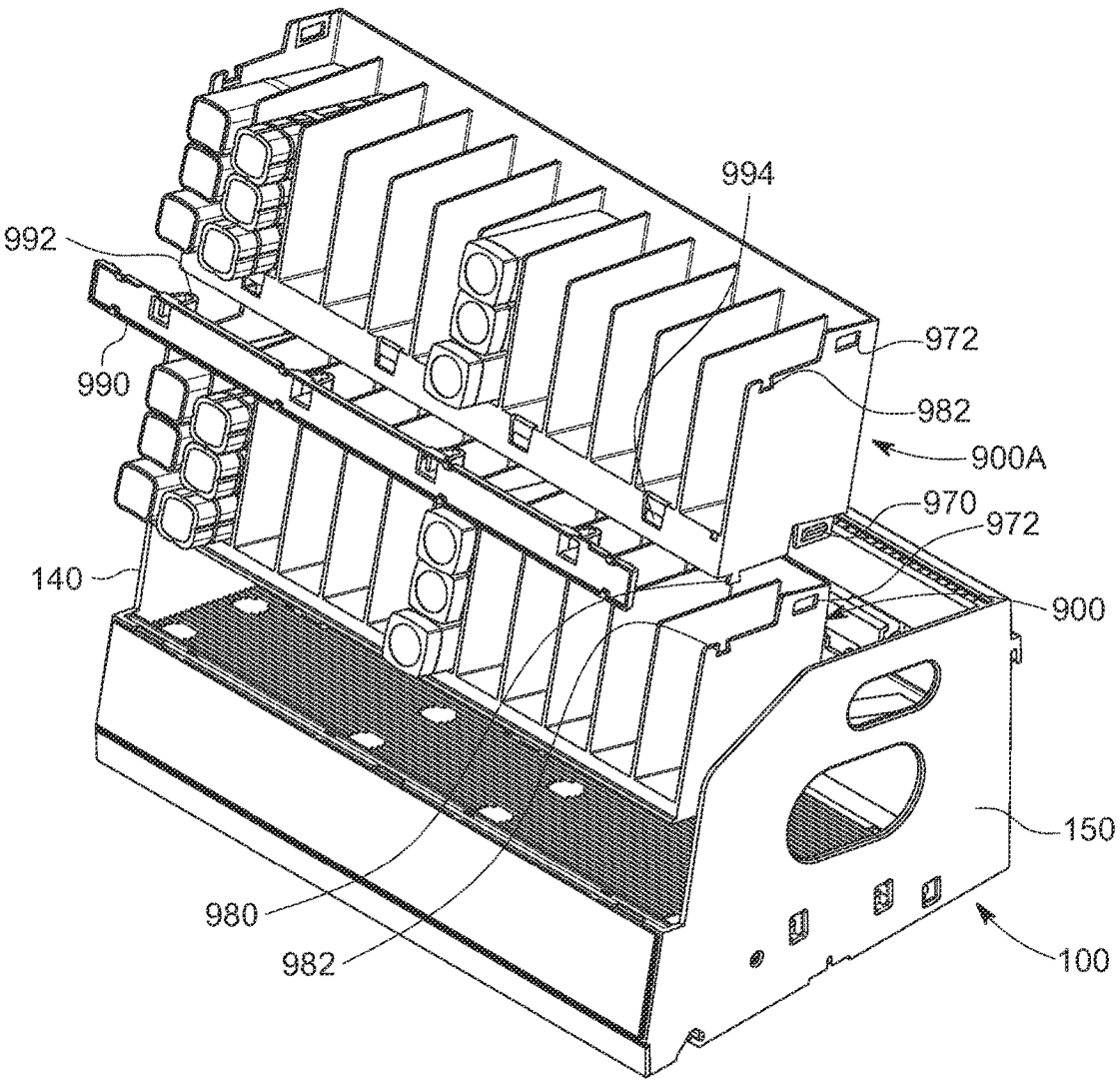
FIG. 12 is an exploded perspective view illustrating a storage system of the present invention that includes the storage device of FIG. 1A.

FIG. 12 illustrates a storage system of the present invention that includes a storage device 100 with a multi-level insert. The multi-level insert is made up of the insert 900 described above and a second insert 900A stacked on top of the insert 900A.

The insert 900 is selectively coupleable with the device 100 as described elsewhere in this specification. Insert 900A can be mountable onto insert 900 via matching clips 970 and clip-receiving opening 972 respectively disposed adjacent to a bottom rear end of the insert 900A and a top rear end of the insert 900, and via matching protrusions 980 and carveouts 982, respectively disposed adjacent to a bottom front end of the insert 900A and a top front end of the insert 900, in order to create a multi-level (e.g., a two-story or taller) storage system (together with the device 100).

FIG. 12 illustrates a clip 970, an opening 972, a protrusion 980 and a carveout 982 on only one side surface of the combination insert 900, 900A, adjacent to the second sidewall 150 of the device 100. However, the combination insert 900, 900A has a similar configuration on its other end, adjacent to the first sidewall 140 of the device 100. Therefore, the inserts 900 and 900A can be selectively coupled with one another in a secure manner as illustrated in FIG. 12 to create a multi-story storage system via the clips 970, openings 970, protrusions 980 and carveouts 982. FIG. 12 illustrates only a two-story insert made up of the inserts 900 and 900A. However, this configuration merely exemplary. Since each insert 900A also includes carveout 982 and an opening 972 adjacent to its top end (at either side of the inert 900A), it is understood that additional inserts 900A may be selectively connected above the insert 900A illustrated in FIG. 12A in order to create a three-story or higher storage system.

As illustrated in FIG. 12, a plate 990 with a plurality of clips 992 is configured to be selectively connected to the insert 990A via a pair of clip-receiving openings 994 in the insert 900A. The plate 900 can be used display information above the items stored in the insert 990A. FIG. 12 also illustrates a plurality of exemplary items 960 that can be displayed in the insert 900A.

Figure 13:
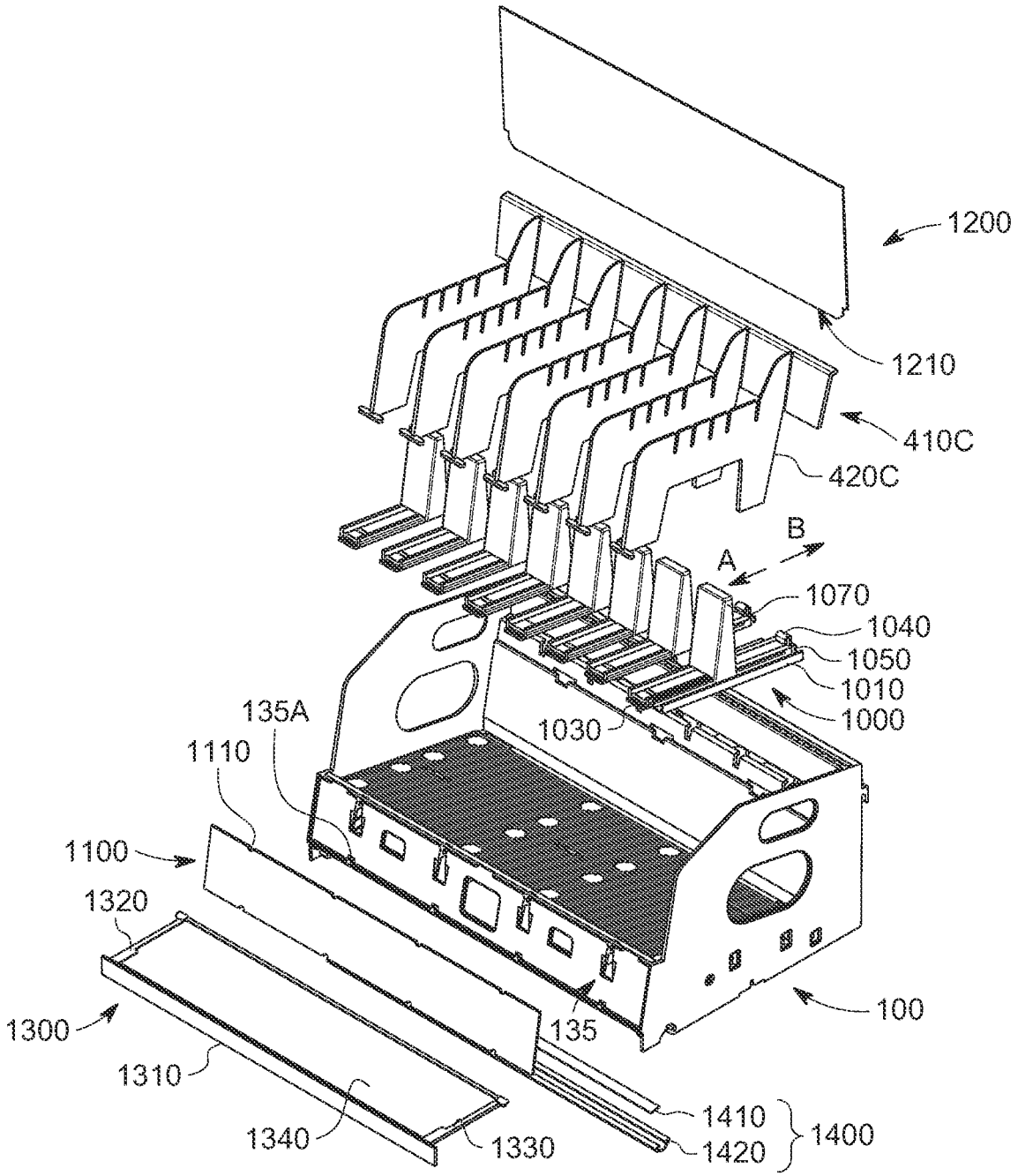
FIG. 13 is an exploded perspective view illustrating a storage system of the present invention that includes the storage device of FIG. 1A.

FIG. 13 is an exploded view of a storage system that includes the storage device 100 with multiple different types of inserts in combination. In particular, an insert 410C provides a plurality of divider walls which create separate compartments. A plurality of pusher assemblies 1000 are selectively connected to the device 100 in each compartment formed by the divider walls. Pusher assemblies attach to the storage device 100 in the same manner as insert 800 of FIG. 10. Also shown is a first display plate 1100 selectively connected to the front wall 130 of the device 100, a second display plate 1200 selectively connected to the back wall 120 of the device 100, a drawer 1300 selectively connected to the device 100 below the bottom wall 110 thereof, and a lighting assembly 1400 selectively connected to the device 100 adjacent to the drawer 1300, below the bottom wall 110 of the device 100.

Referring to FIG. 13, each pusher assembly 1000 includes an elongated body 1010 with a pusher 1070 (or back support 1070) slidably mounted to the body 1010 in a longitudinal direction of the body 1010. As illustrated in FIG. 13, a coiled spring 1080 has one end thereof connected to a front end of the body 1010 (adjacent to the front wall 130 of the device 100), and a second end connected to the pusher 1070. The spring 1080 is configured to bias the pusher 1070 in the direction A illustrated in FIG. 13 in order to guide any items stored onto the body 1010 of the pusher assembly 1000 toward the front wall 130 of the device 100. The pusher 1070 can be pressed in a direction B (see FIG. 13) in order to overcome the force of the spring 1080 and slide the pusher 1070 in the direction B in order to create additional storage space for inserting items on top of the body 1010 of the pusher assembly 1000. The elongated body 1010 of each pusher assembly 1000 includes a protrusion 1030 at a front end of the body 1010, similar to the protrusion 830 of the insert 800, and a flexible upside-down "V" shaped clip 1040, which includes a distal component 850 that is configured to be flexed toward the body 1010, similarly to the "V" shaped clip 840 described above for the device 400. In other words, each pusher assembly 1000 has a structural configuration that enables the pusher assembly 1000 to be selectively connected to and selectively disconnected from the device 100 similarly to the insert 800.

The drawer 1300 includes a body with a front wall 1310, a plurality of sidewalls 1320 and 1330, and a bottom wall 1340 connected to the walls 1310-1330. The drawer 1300 is configured to be accommodated under the bottom wall 110 of the device 100 with a first protrusions 146 in the first sidewall 140 (see FIG. 1D), and a second protrusion 156 in the second sidewall 150 (see FIG. 1E) serving as tracks for holding the sidewalls 1320 and 1330 of the drawer 1300 and enabling the drawer 1300 to be selectively slid in and out from under the bottom wall 130 of the device 100. The bottom wall 1340 may be used to affix a label indicating the items that are stored or intended to be stored in the device 100. Alternatively, a user may elect to mark the bottom wall 1340 directly (e.g., via a pen, a marker, etc.) to indicate the items that are stored or intended to be stored in the device 100. While drawer 1300 is described in detail with reference to FIG. 13, the drawer 1300 is configured to be selectively coupled to the device 100, regardless of what other attachments/inserts are coupled to the device 100.

The first display plate 1100 may be used for affixing a label with information concerning the items that are stored or intended to be stored in the device 100. Alternatively, a user may elect to mark the recessed frontal surface area 135 of the front wall 130 directly to indicate what is stored or intended to be stored in the device 100.

Referring to FIG. 13, the first display plate 1100 includes a body with a perimeter and a plurality of indentations 1110 disposed around the perimeter. Referring to FIGS. 1A and 13, the front wall 130 includes the recessed frontal surface area 135 with a plurality of protrusions 135A disposed around a perimeter of the frontal surface area 135. The recessed frontal area 135 is configured to receive the first display plate 1100 inside of it, with the protrusions 135A of the front wall 130 of the device 100 being selectively coupled to the indentations 1110 of the first display plate 100 in order to maintain the first display plate 1100 connected to the front wall 130 of the device 100. The first display plate 1100 is being described in detail with reference to FIG. 13, but it is understood that the first display plate 1100 is configured to be selectively coupled to the device 100 regardless of what other attachments/inserts are coupled to the device 100.

Referring to FIG. 13, the lighting assembly 1400 includes an elongated light bar 1410 and an elongated lens 1420 selectively coupled to the light bar 1410. The light bar 1410 may include one or more light sources (e.g., light emitting diodes (LEDs), incandescent lamps, fluorescent lamps, etc.) for emitting light downwardly (in the orientation of FIGS. 13A and 13) through the lens 1420. As illustrated in FIG. 13, the lighting assembly 1400 is disposed under the bottom wall 110 of the device 100, adjacent to the front wall 130 of the device 100, in order to emit light generally downwardly. Therefore, the lighting assembly 1400 can illuminate another device 100 (not shown) that would be located under the device 100 of FIG. 13. The lighting assembly 1400 is also configured to illuminate the bottom wall 1340 of the drawer 1300 (of the same device 100) when the drawer 1300 is pulled out of the device 100 due to the proximity between the drawer 1300 and the lighting assembly 1440. In addition, the lighting assembly 1400 may also illuminate the first display plate 1100 via the through openings 132 and 134 of the front wall 130 of the device 100. The lighting assembly 1400 is being described in detail with reference to FIG. 13, but it is understood that the lighting assembly 1400 is configured to be selectively coupled to the device 100 regardless of what other attachments/inserts are coupled to the device 100.

Referring to FIG. 13, the second display plate 1200 has an elongated plate-like bottom region 1210 configured to be selectively connected into the elongated groove 129 defined by the "U"-shaped wall section 125 of the rear wall 120 of the device 100. The second display plate 1200 may, for example, be frictionally engaged with the U-shaped wall section 125 for a secure but selective connection between the plate 1200 and the rear wall 120 of the device 100.

Figure 14:
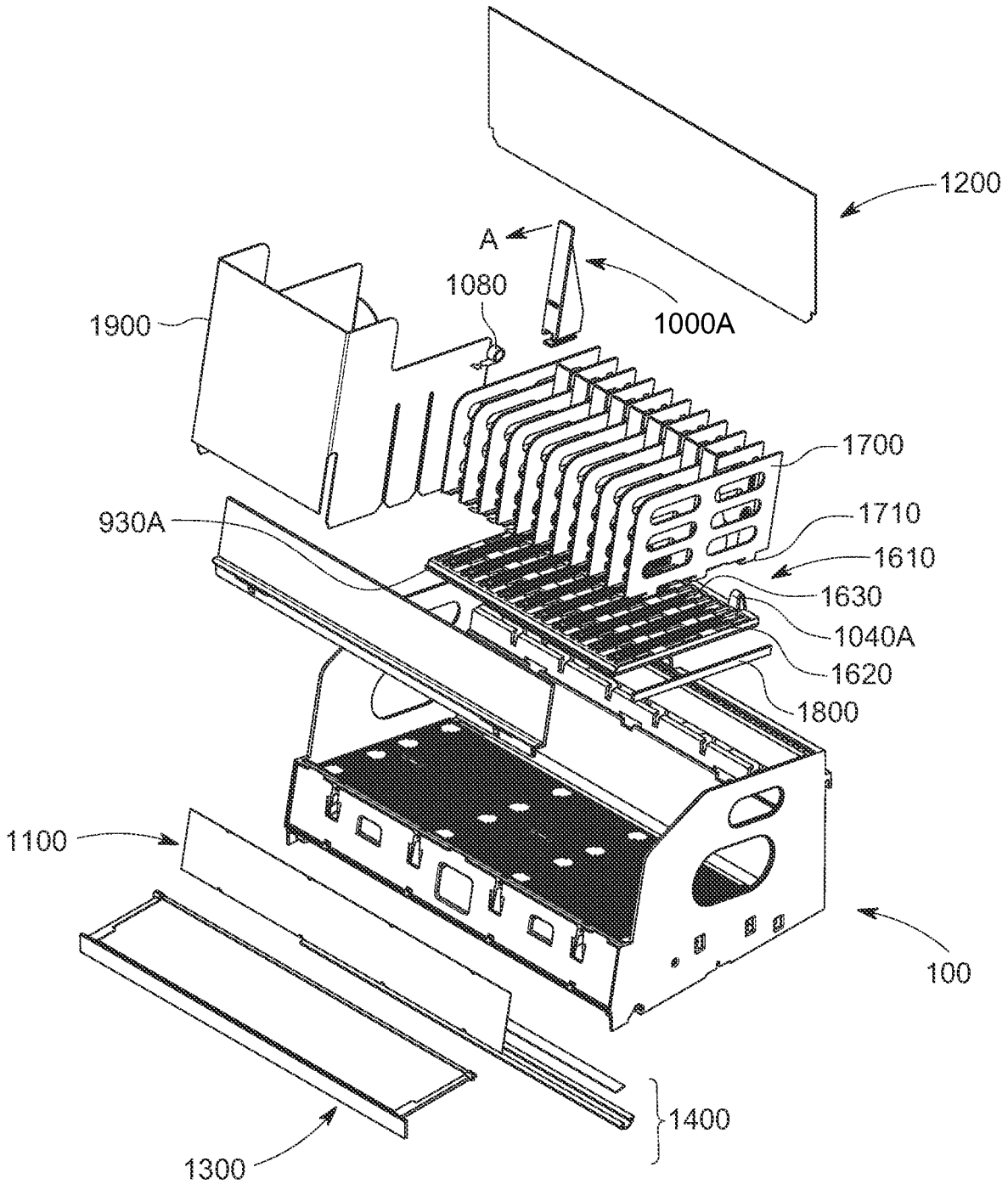
FIG. 14 is an exploded perspective view illustrating a storage system of the present invention that includes the storage device of FIG. 1A.

FIG. 14 illustrates a storage system that includes the storage device 100, an insert assembly 1600 selectively coupled to the storage device 100 and which has tracks for a plurality of pusher assemblies and slots for divider walls, rather than having the pushers individually mounted as in FIG. 13,. Also illustrated is a first display plate 1100 selectively connected to the device 100, a second display plate 1200 selectively connected to the device 100, a drawer 1300 selectively connected to the device 100, and a lighting assembly 1400 selectively connected to the device 100. The coupling between the display plates 1100, 1200, drawer 1300 and lighting assembly 1400 and the device 100 is described above..

Referring to FIG. 14, the insert assembly 1600 includes a base 1610, a plurality of pusher dividing walls 1700 (or dividing walls 1700), a plurality of pushers 1000A disposed between the dividing walls 1700, a strip 1800 disposed on one side of the base 1610, and a three-walled structure 1900 disposed on another side of the base 1610.

Referring to FIG. 14, the base 1610 includes a body with a bar-shaped member 930A on its front side (similar to the bar-shaped member 930 of the insert 900), a pair of flexible upside-down "V"-shaped clip 1040A on its rear side (only one of the pair of clips 1040A is illustrated in FIG. 14) with each clip 1040A being similar to the clips 1040 in configuration and function, a plurality of elongated through openings 1620 arranged in rows in a direction A, a track 1630 disposed between each pair of neighboring rows of through openings 1620, and a pusher 1000A slidably coupled to a respective track 1630 with a spring 1080 connected to each track and to each pusher 1000A in order to bias the respective pusher 1000A in the direction A.

Each dividing wall 1700 has a body with a plurality of "L"-shaped protrusions 1710 disposed at its bottom end. The "L"-shaped protrusions 1710 of each dividing wall 1700 are configured to be inserted and selectively interlocked with a row of the through openings 1620 in the base 1610 in order to selectively connect each dividing wall 1700 with the base 1600Each pusher 1000A is configured to bias any items placed in front of it toward the front wall 130 of the device 100 in order to facilitate display and retrieval of items stored in the compartments formed between each pair of neighboring dividing walls 1700 in the insert assembly 1600.

The three-walled structure 1900 may be connected to the bottom, front and rear walls 110, 130 and 120 of the device 100 in order to create a storage compartment that is separate from those formed by the base 1600 and walls 1700 of the divider assembly 1600 in the interior storage area of the device 100.

Figure 15:
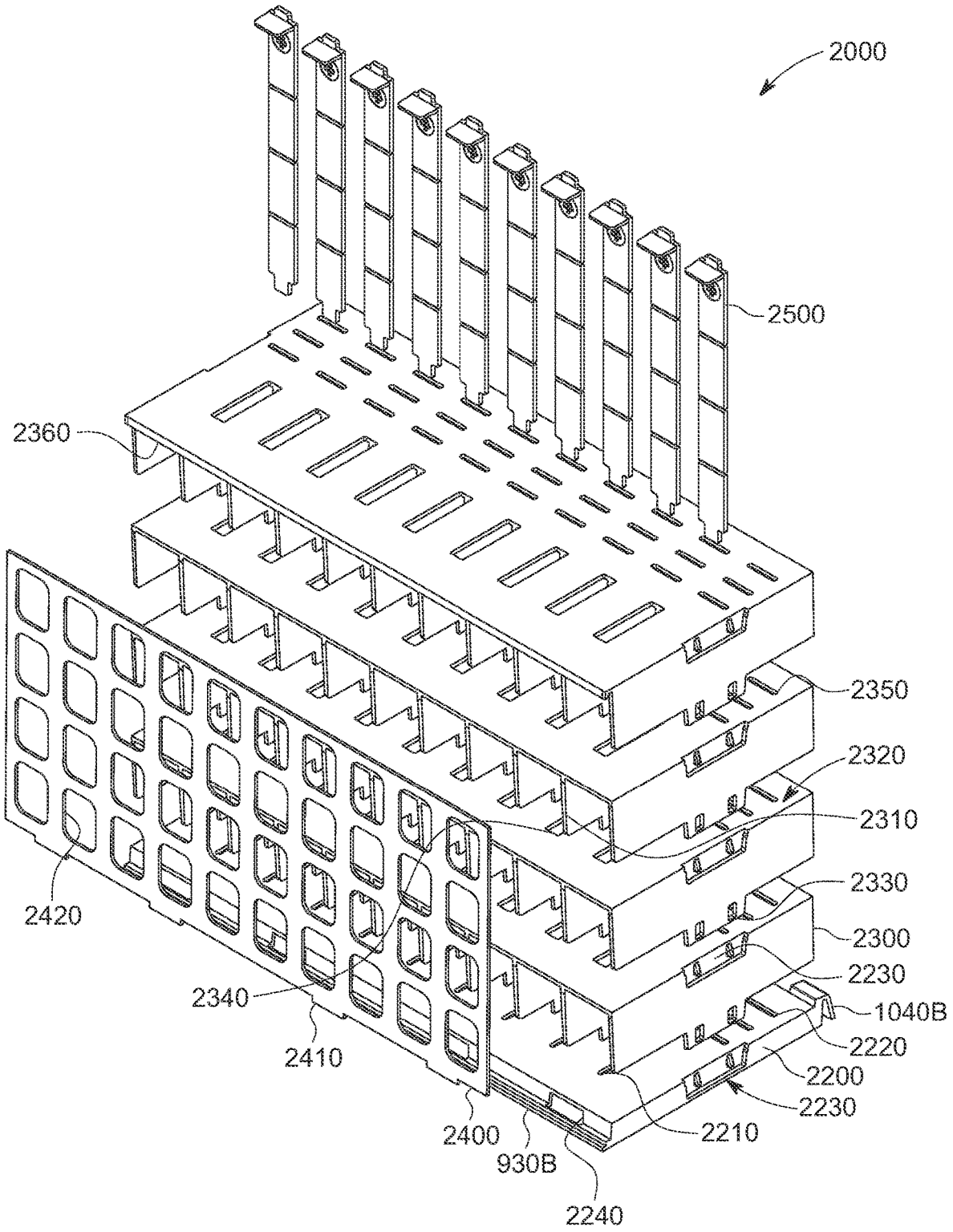
FIG. 15 is an exploded perspective view illustrating an insert that is configured to be selectively coupled to the storage device of FIG. 1A.

FIG. 15 illustrates a storage system that includes the storage device 100 and an insert assembly 2000 selectively coupled to the storage device 100. A plurality of items 2100 are shown as being stored in the insert assembly 2000 for illustrative purposes only.

Referring to FIG. 15 shows another insert assembly embodiment with a base 2200 that can attach to the device 100 in the same manner as the base 1610 of FIG. 14. A variety of different display elements are mounted over base 2200, in this configuration for the display of lipstick or similar items.

More specifically, iinsert assembly 2000 (or assembly of components 2000) includes a base 2200, a plurality of structures 2300 (e.g., compartmentalizing structures) stacked on top of one another over the base 2200, a front faceplate 2400 connected to a front side of the base 2200 and the structures 2300, and a plurality of stock limiters 2500. The base 2200 includes a body with a bar-shaped member 930B on its front side (similar to the bar-shaped member 930 of the insert 900), a pair of flexible upside-down "V" shaped clip 1040B on its rear side (only one of the pair of clips 1040B is illustrated in FIG. 15) with each clip 1040B being similar to the clips 1040 in configuration and function, a plurality of first openings 2210 for receiving protrusions of the structures 2300 from above, a plurality of second openings 2220 for receiving the stock limiters 2500 from above, a recessed area with a pair of protrusions 2230 on each of its two sides (although the recessed area with protrusions 2230 is illustrated only on one side in the figures) for receiving a matching protrusion of a structure 2300 from above, and a plurality of openings 2240 for receiving matching protrusions 2410 of the faceplate 2400 therein.

Each structure 2300 may include a body with a plurality of dividing walls 2310, a top wall 2320, a recessed area with a pair of protrusions 2230 on each of its two sides (although the recessed area with protrusions 2230 is illustrated only on one side in the figures) protrusion 2330 configured to be selectively coupled to a recessed area with protrusions 220 from above, a plurality of first openings 2340 configured to receive lower end portions of the structure 2300 located above therein, and a plurality of second openings 2350 configured to receive the stock limiters 2500 therein. The topmost structure 2300 may also include a protruding lip 2360 configured to maintain the top end of the faceplate 2400 selectively connected to the structures 2300.

The faceplate 2400 may include a plurality of openings 2420 that match with the configuration of the structures 2300 in order to provide an easy and presentable structure for storing and displaying items therein.

Figure 16A:
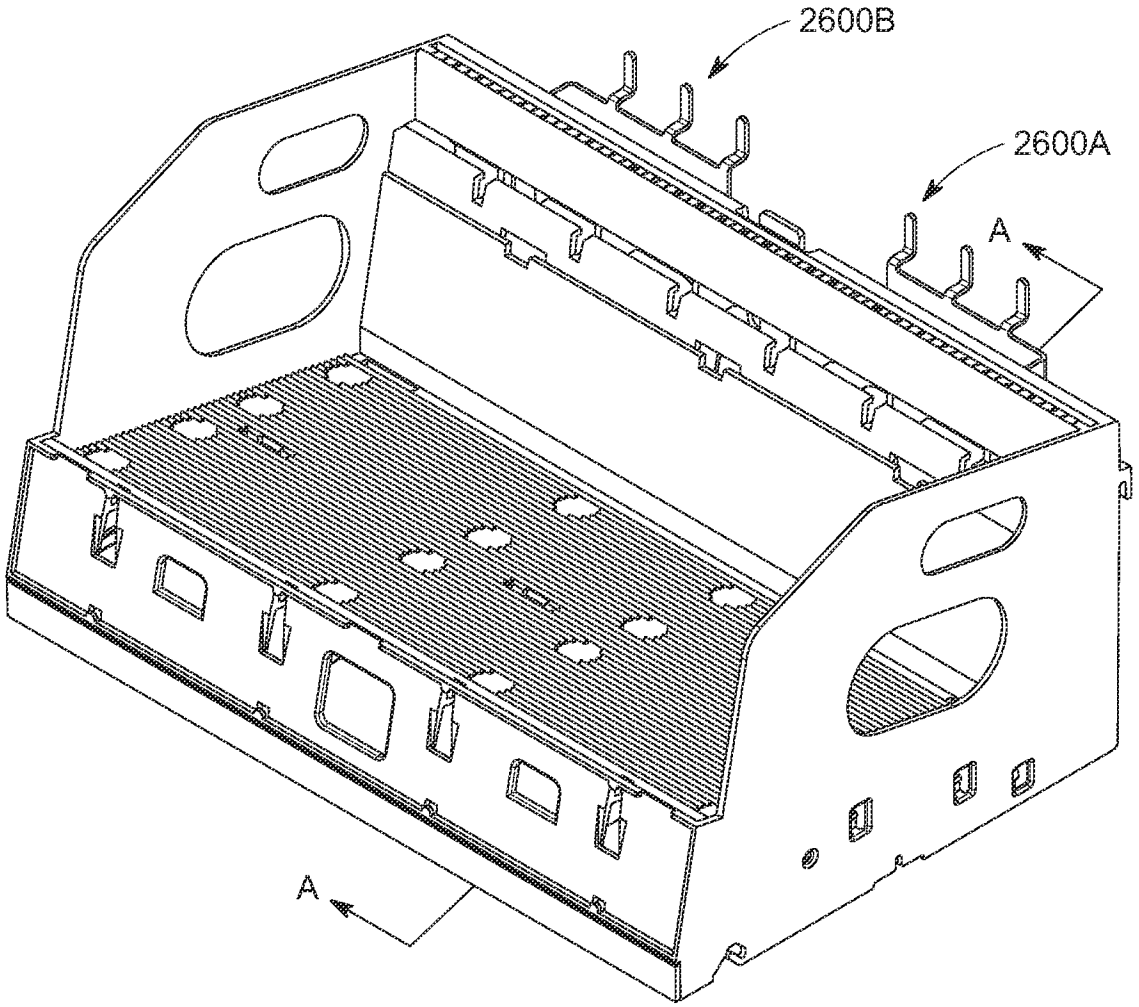
FIG. 16A is a perspective view illustrating a storage system of the present invention that includes the storage device of FIG. 1A selectively coupled to a pair of brackets.
Figure 16B:
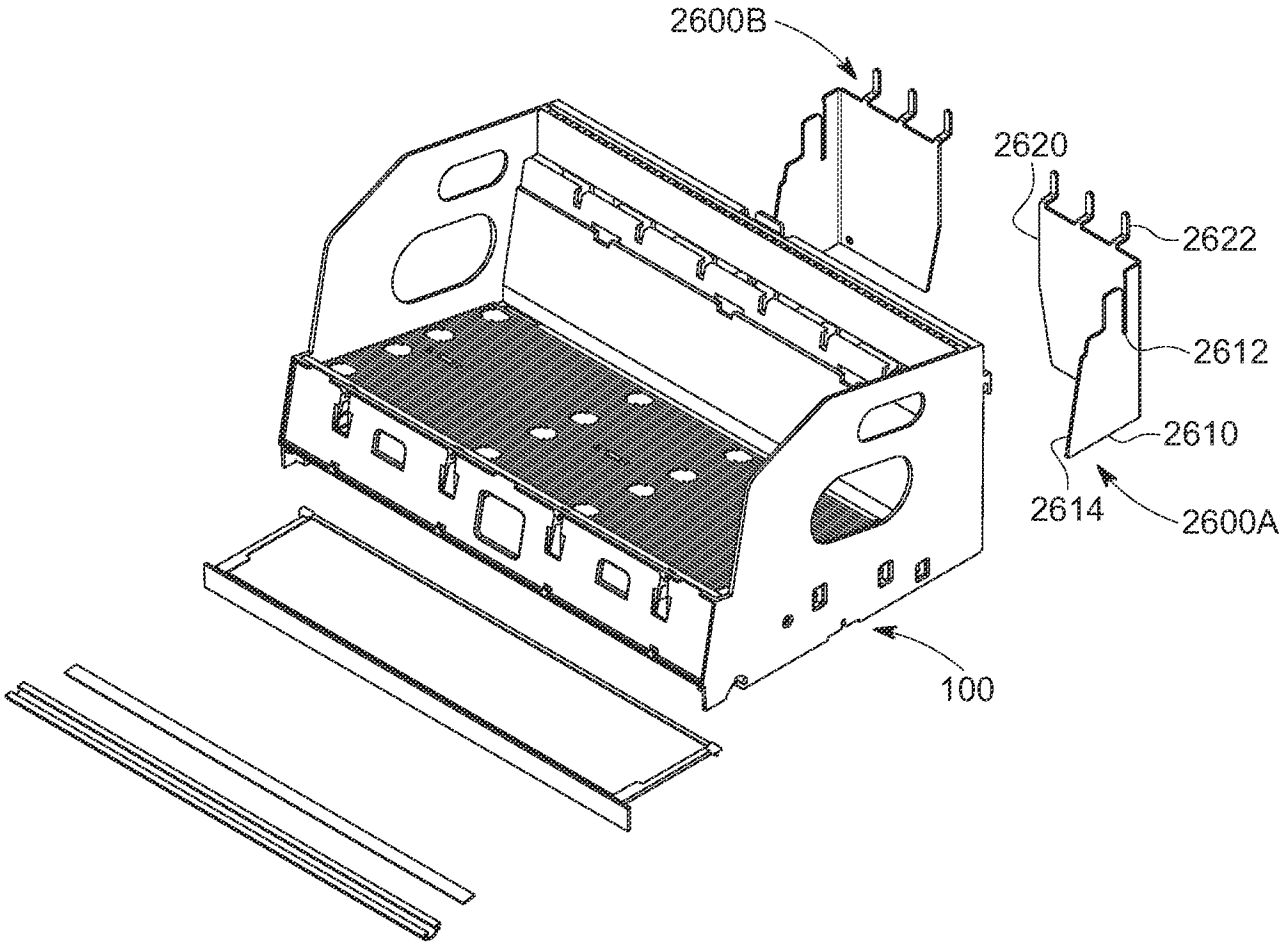
FIG. 16B is an exploded perspective view illustrating the storage system of FIG. 16A.
Figure 16C:
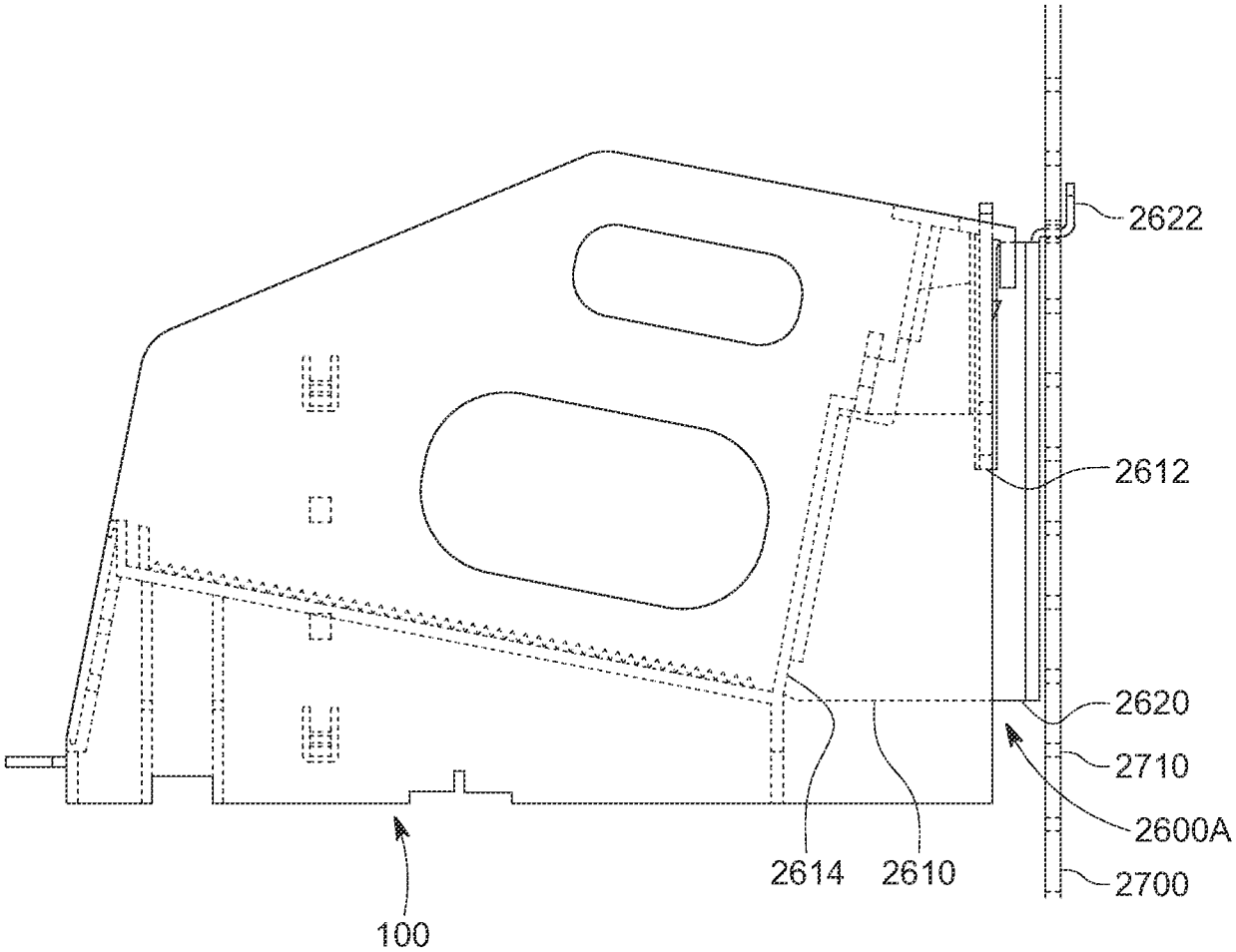
FIG. 16C is a cross-sectional view taken alone line A-A of FIG. 16A.

FIGS. 16A-16C illustrate the device 100 selectively coupled to a pair of brackets 2600A and 2600B which can be used to selectively attach the device 100 to a load-bearing wall as an alternative to using the "L"-shaped protrusion 121.

The brackets 2600A and 2600B may have a mirrored configuration relative to one another. Therefore, only the bracket 2600A will be described for brevity purposes.

Referring to FIGS. 16B-16C, the bracket 2600A includes a first plate-like structural member 2610 and a second plate-like structural member 2620 extending from the member 2620 in a different direction than the member 2610. The first structural member 2610 includes a recess 2612 that is configured to accommodate the back wall section 127 of the rear wall 120 of the device 100 therein (when coupled to the device 100) and an outer periphery 2614 configured to contact the lower and upper wall sections 122 and 124 of the wall 120 (when coupled to the device 100).

Referring to FIG. 16B-16C, the second structural member 2620 may include a plurality of times 2622 in an "L"-shape configuration protruding upwardly and away from the bracket 2600. The tines 2622 are configured to be inserted in a row of matching through openings 2710 in a load-bearing wall 2700 in order to selectively connect the device 100 to the load-bearing wall 2700 (see FIG. 16C). The length of the first structural member 2610 of the bracket 2600A may be elongated, if needed, in order to increase the separation distance between the device 100 and the load-bearing wall 2700.

Figure 17:
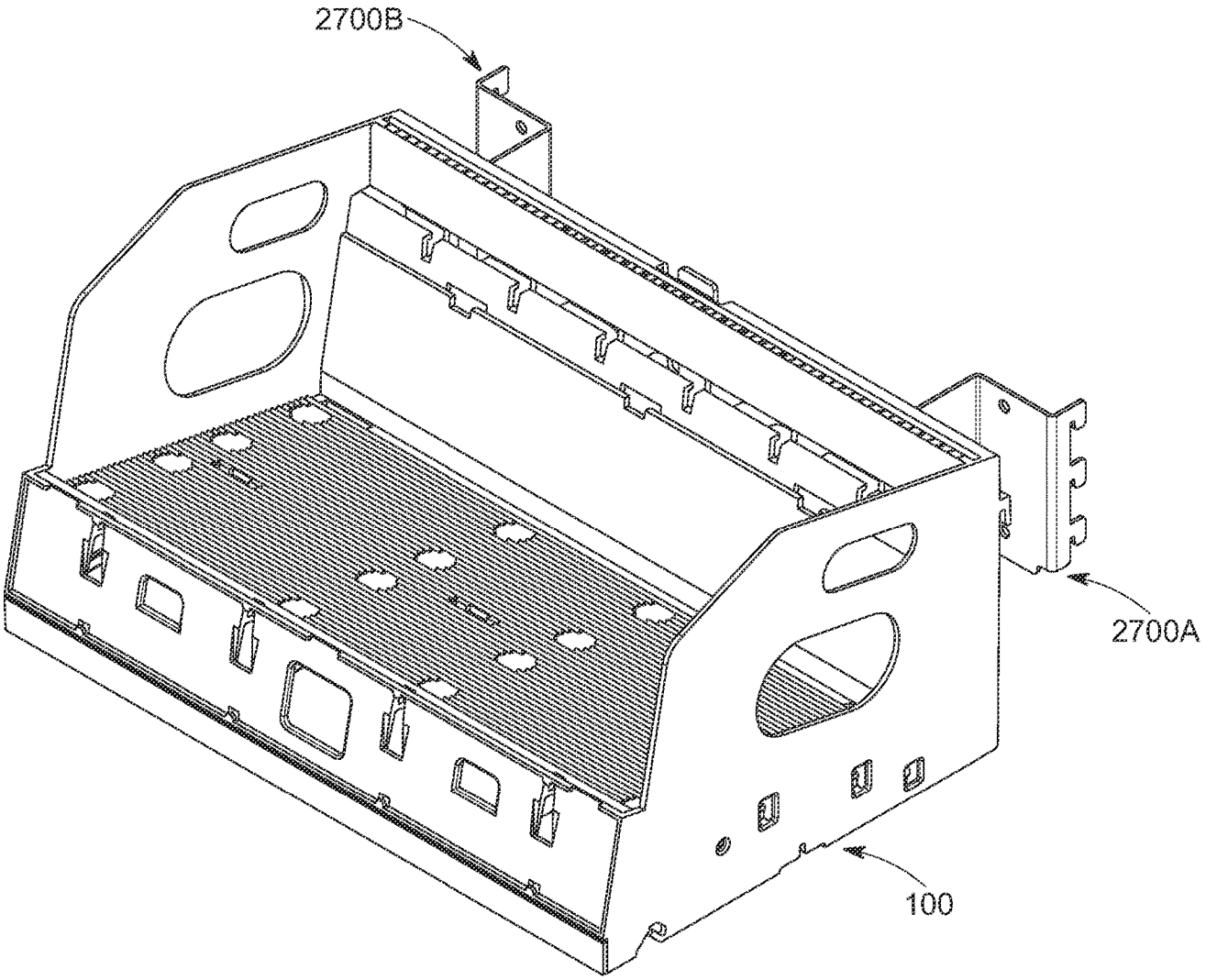
FIG. 17 is a perspective view illustrating a storage system of the present invention that includes the storage device of FIG. 1A selectively coupled to a pair of brackets.

FIG. 17 illustrates the device 100 selectively coupled to a pair of brackets 2700A and 2700B. The brackets 2700A and 2700B may have a mirrored configuration relative to one another. Therefore, only the bracket 2700A will be described for brevity purposes.

Referring to FIG. 17, the bracket 2700A includes a first structural member 2710 and a second structural member 2720 extending from the member 2720 in a different direction than the member 2710. The first structural member 2710 may be similar to or the same as the first structural member 2610 of the bracket 2600A. Therefore, a duplicate description thereof may be omitted for brevity. Referring to FIG. 17, the second structural member 2720 may include a plurality of times 2722 in an "L"-shape configuration protruding upwardly and away from the bracket 2600. The tines 2722 are arranged vertically (as opposed to the horizontally-oriented tines 2622 of the bracket 2600A), and are configured to be inserted in a column of matching through openings 2710 in a load-bearing wall in order to selectively connect the device 100 to the load-bearing wall. The length of the first structural member 2710 of the bracket 2700A may be elongated, if needed, in order to increase the separation distance between the device 100 and the load-bearing wall.

The brackets of FIGS. 16A-C and 17 can be made of a conducting metal. If the brackets are mounted to supports that carry electricity they can be used to convey power from the supports to the device 100 for the lighting or other electrical display components. In such a configuration, wires to power the electronic components in the display assembly can be screwed, clipped, or otherwise attached to the metal brackets.

While the present invention has been particularly shown and described with reference to exemplary embodiments thereof, it will be apparent to those of ordinary skill in the art that various changes in form and detail may be made therein without departing from the spirit and scope of the present invention as defined by the following claims.

What is claimed is:

1. A storage system comprising:

a storage device, the storage device including:

a front wall;

a rear wall;

a bottom wall connecting the front and rear walls to one another;

a first sidewall connecting the front, rear and bottom walls to one another at a first side of the storage device, and a second sidewall connecting the front, rear and bottom walls to one another at a second side of the storage device, opposite to the first side thereof, wherein the front wall, rear wall, bottom wall, first sidewall and second sidewall of the storage device define an interior storage area in the storage device and an opening configured to permit access to the interior storage area such that items can be stored in the interior storage area, displayed to an outside of the storage device through the opening, and retrieved from the interior storage area; and an insert selectively coupled to at least one of the front and rear walls in the interior storage area of the storage device, wherein the insert is configured to compartmentalize the interior storage area of the storage device, wherein the front wall includes a first lip section protruding over the bottom wall of the storage device, the first lip section and the bottom wall defining a first insertion slot in the storage device, and wherein the insert includes an elongated body with a front end and a rear end, the front end of the body of the insert including an elongated protrusion, wherein the elongated protrusion is inserted in the first insertion slot, and the rear end of the body of the insert is connected to the rear wall of the storage device, wherein the body of the insert further includes a "V"-shaped clip connected to the rear end thereof, wherein the "V"-shaped clip is in contact with the rear wall of the storage device, and the "V"-shaped clip is configured to apply a spring force to the rear wall of the storage device in order to secure the body of the insert in the interior storage area of the storage device, wherein the insert further includes:

a pusher slidably mounted to the elongated body of the insert, the pusher extending in a direction that crosses a direction which the elongated body of the insert extends; and a spring having one end thereof connected to the elongated body of the insert, adjacent to the front end thereof, and a second end thereof connected to the pusher, wherein the spring is configured to bias the pusher toward the front end of the storage device, wherein the elongated body of the insert, the spring and the pusher define a first pusher assembly, the storage system further including a second pusher assembly disposed adjacent to the first pusher assembly, wherein the front wall of the storage device further includes a second lip section protruding over the bottom wall of the storage device, the second lip section and the bottom wall of the storage device defining a second insertion slot in the storage device, wherein the first and second lip sections are separated from one another by a gap along the front wall of the storage device wherein the second pusher assembly includes:

an insert with an elongated body having a front end and a rear end, the front end of the body of the insert of the second pusher assembly including an elongated protrusion, wherein said elongated protrusion is inserted in the second insertion slot, and the rear end of the body of the insert of the second pusher assembly is connected to the rear wall of the storage device, the rear end of the elongated body of the insert of the second pusher assembly including a "V"-shaped clip in contact with the rear wall of the storage device;

a pusher slidably mounted to the elongated body of the insert of the second pusher assembly, the pusher extending in a direction that crosses a direction which the elongated body of the insert of the second pusher assembly extends; and a spring having one end thereof connected to the elongated body of the insert of the second pusher assembly, adjacent to the front end thereof, and a second end thereof connected to the pusher of the second pusher assembly, wherein the spring is configured to bias the pusher of the second pusher assembly toward the front end of the storage device, the storage system further including a second insert selectively connected to the rear wall of the storage device, the second insert including:

a back wall extending in a first direction between the first and second sidewalls of the storage device, the back wall including a first side surface facing the front wall of the storage device and a second side surface, opposite to the first side surface thereof, facing the rear wall of the storage device;

a divider extending from the first side surface of the back wall, between the first and second pusher assemblies, along the respective lengths of the first and second pusher assemblies; and a pair of clips extending from the second side surface of the back wall;

wherein the rear wall of the storage device includes a lower wall section connected to the bottom wall of the storage device, an upper wall section, and a gap separating the upper and lower wall sections along their respective lengths, wherein the a "V"-shaped clips of the first and second pusher assemblies are in contact with the lower wall section of the rear wall of the storage device, and wherein the pair of clips of the second insert extend through the gap separating the upper and lower wall sections of the rear wall of the storage device.

2. The storage system of claim 1, wherein an end of the divider of the second insert that is opposite to the back wall thereof extends in the gap that separates the first and second lip sections of the front wall of the storage device from one another.

3. The storage system of claim 2, wherein the end of the divider that is inserted in the gap between the first and second lip sections further includes a bar-shaped member extending in the first and second insertion slots of the storage device.

4. The storage system of claim 1, further comprising a lighting bar disposed on a surface of the bottom wall of the storage device that is opposite to the interior storage area of the storage device.

5. The storage system of claim 1, wherein the front wall, first sidewall and second sidewall of the storage device include through openings in order to reduce a weight of the storage device.

6. The storage system of claim 1, wherein the storage device is made of a polymeric material, a metal or wood.

7. The storage system of claim 6, wherein the polymeric material is acrylonitrile butadiene styrene (ABS).

* * * * *